United States Patent [19]

Matsuura et al.

[11] Patent Number: 4,597,938

[45] Date of Patent: Jul. 1, 1986

[54] PROCESS FOR PRODUCING PERMANENT MAGNET MATERIALS

[75] Inventors: Yutaka Matsuura, Ibaraki; Masato Sagawa, Nagaokakyo; Setsuo Fujimura, Kyoto, all of Japan

[73] Assignee: Sumitomo Special Metals Co., Ltd., Osaka, Japan

[21] Appl. No.: 532,517

[22] Filed: Sep. 15, 1983

[30] Foreign Application Priority Data

| | | | |
|---|---|---|---|
| May 21, 1983 | [JP] | Japan | 58-88372 |
| May 21, 1983 | [JP] | Japan | 58-88373 |
| May 24, 1983 | [JP] | Japan | 58-90038 |
| May 24, 1983 | [JP] | Japan | 58-90039 |

[51] Int. Cl.[4] ..... B22F 3/16; C22C 33/02; C22C 38/32

[52] U.S. Cl. ..... 419/23; 29/608; 148/105; 75/244; 419/10; 419/12; 419/38; 419/46; 419/57

[58] Field of Search ..... 419/10, 12, 48, 38, 419/23, 45, 46, 57; 75/244; 29/608; 148/105

[56] References Cited

U.S. PATENT DOCUMENTS

| | | | |
|---|---|---|---|
| 414,936 | 9/1882 | Croat . | |
| 508,266 | 6/1883 | Croat . | |
| 3,560,200 | 2/1971 | Nesbitt et al. | 419/29 |
| 4,063,970 | 12/1977 | Steingroever | 419/10 |
| 4,402,770 | 9/1983 | Koon . | |
| 4,533,408 | 8/1985 | Koon . | |

FOREIGN PATENT DOCUMENTS

| | | |
|---|---|---|
| 50-1397 | 1/1975 | Japan . |
| 52-50598 | 4/1977 | Japan . |
| 53-28018 | 3/1978 | Japan . |
| 54-76419 | 6/1979 | Japan . |
| 55-115304 | 9/1980 | Japan . |
| 55-113304 | 9/1980 | Japan . |
| 56-29639 | 3/1981 | Japan . |
| 56-47542 | 4/1981 | Japan . |
| 56-47538 | 4/1981 | Japan . |
| 56-116844 | 9/1981 | Japan . |
| 58-123853 | 1/1982 | Japan . |
| 57-141901 | 9/1982 | Japan . |
| 2021147 | 11/1979 | United Kingdom . |
| 2100286 | 12/1982 | United Kingdom . |
| 833049091 | 5/1984 | United Kingdom . |

OTHER PUBLICATIONS

Handbook on the Physics and Chemistry of Rare Earths, vol. 2, Chapter 14, pp. 55-56, 155-161.

J. J. Croat, "Permanent Magnet Properties of Rapidly Quenched Rare Earth—Iron Alloys", IEEE Trans. Mag., vol. MAG-18, No. 6, Nov., 1982, pp. 1442-1447.

Neumann et al., "Line Start Motors Designed with Nd-Fe-B Permanent Magnets", pp. 77-89.

R. K. Mishra, "Microstructure of Melt—Spun Neodymium—Iron—Boron Magnets", International Conference on Magnetism, 1985.

Lee, "The Future of Rare Earth-Transition Metal Magnets of Type $RE_2TM_{17}$", J. Appl. Phys., vol. 52, Mar., 1981, pp. 2549-2553.

Croat, "Pr—Fe and Nd—Fe—Based Materials: A New Class of High—Performance Permanent Magnets", J. Appl. Phys., vol. 55, Mar. 15, 1984, pp. 2078-2082.

Ohashi et al., "Effects of Prasedymium Substitution on Precipitation Hardened Rare Earth Magnets", pp. 493-501.

(List continued on next page.)

*Primary Examiner*—Allan M. Lieberman

*Attorney, Agent, or Firm*—Burns, Doane, Swecker and Mathis

[57] ABSTRACT

Permanent magnet materials of the Fe-B-R type are produced by:

preparing a metallic powder having a mean particle size of 0.3-80 microns and a composition of 8-30 at % R, 2-28 at % B, and the balance Fe, compacting, and sintering, at a temperature of 900-1200 degrees C.

Co up to 50 at % may be present. Additional elements M (Ti, Ni, Bi, V, Nb, Ta, Cr, Mo, W, Mn, Al, Sb, Ge, Sn, Zr, Hf) may be present. The process is applicable for anisotropic and isotropic magnet materials.

32 Claims, 17 Drawing Figures

OTHER PUBLICATIONS

Chaban et al., "Ternary Nd, Sm, Gd - Fe—B Systems", LVOV State University, pp. 873-875.

Greedan et al., "An Analysis of the Rare Earth Contribution to The Magnetic Anisotropy in $RCo_5$ and $R_2Co_{17}$ Compounds", Journal of Solid State Chemistry, vol. 6, 1973, pp. 387-395.

Leamy et al., "The Structue of Co—Cu—Fe—Ce Permanent Magnets", IEEE Transactions on Magnetics, vol. MAG—9, No. 3, Sep. 1973, pp. 205-209.

Ray et al., "Easy Directions on Magnetization in Ternary $R_2$(Co,Fe) Phases", IEEE Transactions on Magnetics, Sep. 1972, pp. 516-518.

Melton et al., "A Electron Microscope Study of Sm—Co—Cu—Based Magnetic Materials with the $Sm_2Co_{17}$ Structure", J. Appl. Phys., vol. 48, No. 6, Jun. 1977, pp. 2608-2611.

Ormerod, "Processing and Physical Metallurgy of NdFeB and Other Rare Earth Magnets", pp. 69-92.

Senno et al., "Magnetic Properties of Sm—Co—Fe—Cu Alloys for Permanent Magnetic Materials", Japan J. Appl. Phys., vol. 14, (1975), No. 10, pp. 1619-1620.

Handbook on the Physics and Chemistry of Rare Earths, vol. 2, Chapter 15, pp. 231-241.

Croat, "Preparation and Coercive Force of Melt—Spun Pr—Fe Alloys", Appl. Phys. Lett., vol. 37, Dec. 15, 1980, pp. 1096-1098.

Lee, "Hot-Pressed Neodymium-Iron-Boron Magnets", Appl. Phys. Lett. vol. 46, Apr. 15, 1985, pp. 790-791.

Koon et al., "A New Class of Melt Quenched Amorphous Magnetic Alloys", Naval Research Lab., Washington, D.C., PACS No. 75.50Kj, 75.60 Gm.

Burzo, "Some New Results in the Field of Magnetism of Rare Earth Compounds", Acta Physica Polonica, Mar., 1985, pp. 1-17 w/drawings.

Koon et al., "Rare—Earth Transition Metal Exchange Interactions in Amorphous $(Fe_{0.82}B_{0.18})_{0.9}R_xLa_{0.1-x}$ Alloys", J. Appl. Phys., vol. 53, Mar. 1982, pp. 2333-2334.

Koo, "Partial Substitution of Sm with Neodymium, Praseodymium, and Mischmetal in $RE_2TM_{17}$ Permanent Magnets", IEEE Transactions on Magnetics, vol. MAG-20, No. 5, Sep. 1984, pp. 1593-1595.

Koon et al., "Magnetic Properties of Amorphous and Crystallized $(Fe_{0.82}B_{0.18})_{0.9}Tb_{0.05}$", Appl. Phys. Lett., vol. 39, Nov. 15, 1981, pp. 640-642.

Givord et al., "Crystal Chemistry and Magnetic Properties of the $R_2Fe_{14}B$ Family of Compounds", Oct. 25, 1984, pp. 131-142.

Handbook on the Physics and Chemistry of Rare Earths, vol. 2, Chapter 16, "Amorphous Magnetic Rare Earth Alloys", pp. 259-294.

"Neomax—Neodimium Iron Magnet—", Sumitomo Special Metals Co., Ltd.

Sagawa et al., "Permanent Magnet Materials Based on the Rare Earth—Iron—Boron Tetragonal Compounds", The Research Institute for Iron, Steel and Othe Metals, Tohoku University, Japan.

Hadjipanayis et al., "Investigation of Crystalline Iron--Platinum Nickel and Amorphous Rare-Earth Alloys for Permanent Magnets", Mar. 15, 1983, pp. 1-79 w/Appendix.

Nezu et al., "$Sm_2$(Co, Fe, Cu)$_{17}$ Permanent Magnet Alloys with Additive Element Hf", pp. 437-449.

Mainichi Daily News, Saturday, Jun. 4, 1983, "Strongest Magnet Unveiled".

Sagawa et al., "New Material for Permanent Magnets on a Base of Nd, and Fe", J. Appl. Phys., vol. 55, Mar. 15, 1984, p.2083.

Japanese High Technology, Aug. 1984, vol. 4, No. 5.

Kabacoff et al., "Thermal and Magnetic Properties of Amorphous $Pr_x(Fe_{0.8}B_{0.2})_{1-x}$", J. Appl. Phys., vol. 53, Mar. 1982, pp. 2255-2257.

Gupta et al., "Magnetization Process and Reversal in $Sm_3Co_{11}B_4$", Journal of Magnetism and Magnetic Materials, vol. 40, 1983, pp. 32-36.

Koon et al., "Crystallization of FeB Alloys with Bare Earth to Produce Hard magnetic Materials", J. Appl. Phys., vol. 55, Mar. 15, 1984, pp. 2063-2066.

Chikazumi, "Physics of Magnetism", pp. 18, 498-499.

Croat et al., "High—Energy Produce Nd—Fe—B Permanent Magnets", Appl. Phys. Lett., vol. 44, Jan. 1984, pp. 148-149.

Nagel et al., "Influence of Cu-Content on the Hard Magnetic Properties of Sm(co,Cu) 2:17 Compounds", IEEE Transactions on Magnetics, vol. MAG-14, No. 5, Sep. 1978, pp. 671-673.

Hadjipanayis et al., "New Iron—Rare Earth Base Permanent Magnet Materials", Appl. Phys. Lett., vol. 43, Oct. 15, 1983, pp. 797-799.

Ojima et al., "Magnetic Properties of a New Type of Rare-Earth Cobalt Magnets: $Sm_2$(CO, Cu, Fe, M)$_{17}$", IEEE Transactions on Magnetics, vol, MAG-13, No. 5, Sep. 1977, pp. 1317-1319.

El Masry et al., "Magnetic Moments and Coercive Forces in the hexagonal Boride Homologous Series $Co_{3n+5}R_{n+1}B_{2n}$ with R=Gd and Sm", pp. 33-37.

Robinson, "Powerful New Magnet Material Found", Science, vol. 233, Mar. 2, 1984, pp. 920-922.

Stadelmaier, "Cobalt—Free and Samarium—Free Permanent Magnet Materials Based on an Iron—Rare Earth Boride", Dept. of Materials Eng., N. C. State University, Sep. 1, 1983, pp. 1-9.

Givord et al., "Magnetic Properties and Crystal Structure of $Nd_2Fe_{14}B$", Solid State Comm., vol. 50, No. 6, Feb., 1984, pp. 497-499.

Herbst et al., "Relationships Between Crystal Structure and Magnetic Properties in $Nd_2Fe_{14}B$", Phys. Dept., General Motors Res. Lab., pp. 1-10.

El Masry et al., "Substitution of Iron for Cobalt in Rare Earth Boride Permanent Magnets of the Type $Co_{3n+5}Sm_{n+1}B_{2n}$", Dept. of Materials, N.C. State Un., Feb., 1983, pp. 86-88.

Stadelmaier, "

El Masry et al., "Phase Equilibria in the Co-Sm-B System", Journal of the Less-Common Metals, vol. 96, Jan., 1984, pp. 165-170.

Stadelmaier, "The Neodymium-Iron Permanent Magnet Breakthrough", Magnetic Materials Products Assoc., Jan., 1984, pp. 1-15.

Topp, "The Chemistry of the Rare-Earth Elements", Topics in Inorganic and General Chemistry, 1965, pp. 1-12.

PROCESS FOR PRODUCING PERMANENT MAGNET MATERIALS

BACKGROUND OF THE INVENTION

Permanent magnet materials are one of the important electric and electronic materials in wide ranges from various electric appliances for domestic use to peripheral terminal devices for large-scaled computers. In view of recent needs for miniaturization and high efficiency of electric and electronic equipment, there has been an increasing demand for upgrading of permanent magnet materials.

Major permanent magnet materials currently in use are alnico, hard ferrite and rare earth-cobalt magnets. Recent advances in electronics have demanded particularly small-sized and light-weight permanent magnet materials of high performance. To this end, the rare earth-cobalt magnets having high residual magnetic flux densities and high coercive forces are being predominantly used.

However, the rare earth-cobalt magnets are very expensive magnet materials, since they contain costly rare earth such as Sm and costly cobalt in larger amounts of up to 50 to 60% by weight. This poses a grave obstacle to the replacement of alnico and ferrite for such magnets.

In an effort to obtain such permanent magnets, RFe base compounds were proposed, wherein R is at least one of rare earth metals. A. E. Clark discovered that sputtered amorphous TbFe had an energy product of 29.5 MGOe at 4.2 K., and showed a coercive force Hc=3.4 kOe and a maximum energy product (BH)max=7 MGOe at room temperature upon heat treating at 300–500 degrees C. Reportedly, similar studies of $SmFe_2$ indicated that 9.2 MGOe was reached at 77 K.

In addition, N. C. Koon et al discovered that, with melt-quenched ribbons of $(Fe_{0.82}B_{0.18})_{0.9}Tb_{0.05}La_{0.05}$, Hc of 9 kOe or more was reached upon annealing at about 875 K. However, the (BH)max of the obtained ribbons were then low because of the unsatisfactory loop rectangularity of the demagnetization curves thereof (N. C. Koon et al, Appl. Phys. Lett. 39(10), 1981, pp. 840–842, IEEE Transaction on Magnetics, Vol. MAG-18, No. 6, 1982, pp. 1448–1450).

Moreover, J. J. Croat and L. Kabacoff et al have reported that the ribbons of PrFe and NdFe compositions prepared by the melt-quenching technique showed a coercive force of nearly 8 kOe at room temperature (L. Kabacoff et al, J. Appl. Phys. 53(3)1981, pp. 2255–2257; J. J. Croat IEEE Vol. 118, No. 6, pp. 1442–1447).

These melt-quenched ribbons or sputtered thin films are not practical permanent magnets (bodies) that can be used as such, and it would be impossible to obtain therefrom practical permanent magnets. In other words, it is impossible to obtain bulk permanent magnets of any desired shape and size from the conventional melt-quenched ribbons based on FeBR and sputtered thin films based on RFe. Due to the unsatisfactory loop rectangularity or squareness of the magnetization curves, the FeBR base ribbons heretofore reported are not taken as practical permanent magnets comparable with the ordinarily used magnets. Since both the sputtered thin films and the melt-quenched ribbons are magnetically isotropic by nature, it is indeed almost impossible to obtain therefrom any magnetically anisotropic permanent magnets of high performance (hereinafter called the anisotropic permanent magnets) for practical purposes.

As mentioned above, many researchers have proposed various processes to prepare permanent magnets from alloys based on rare earth elements and iron, but none have given satisfactory permanent magnets for practical purposes.

SUMMARY OF THE INVENTION

An object of the present invention is therefore to eliminate the disadvantages of the prior art processes for the preparation of permanent magnet materials based on rare earth and iron, and to provide novel practical permanent magnet materials and a technically feasible process for the preparation of same.

Another object of the present invention is to obtain practical permanent magnet materials which possess good magnetic properties at room temperature or elevated temperature, can be formed into any desired shape and size, and show good loop rectangularity of demagnetization curves as well as magnetic anisotropy or isotropy, and in which as R relatively abundant light rare earth elements can effectively be used.

More specifically, the FeBR base magnetic materials according to the present invention can be obtained by preparing basic compositions consisting essentially of, atomic percent, 8 to 30% R representing at least one of rare earth elements inclusive of Y, 2 to 28% B and the balance being Fe with inevitable impurities, forming, i.e., compacting alloy powders having a particle size of 0.3 to 80 microns, and the compacted body of said alloy powders at a temperature of 900 to 1200 degrees C. in a reducing or non-oxidizing atmosphere.

The magnet materials of the present invention in which as R relatively abundant light rare earth elements such as Nd or Pr are mainly used do not necessarily contain expensive Co, and show (BH)max of as high as 36 MGOe or more exceeding by far the maximum value, (BH)max=31 MGOe, of the conventional rare earth-cobalt magnets.

It has further been found that the compound magnets based on FeBR exhibit crystalline X-ray diffraction patterns distinguished entirely over those of the conventional amorphous thin films and melt-quenched ribbons, and contain as the major phase a crystal structure of the tetragonal system. In this respect, the disclosure in U.S. Patent Application Ser. No. 510,234 filed on July 1, 1983 is herewith incorporated herein. In accordance with the present invention, the Curie points (temperatures) of the magnet materials can be increased by the incorporation of Co in an amount of 50 at % or below. Furthermore, the magnetic properties of the magnet materials can be enhanced and stabilized by the incorporation of one or more of additional elements (M) in specific at %.

In the following the present invention will be described based on the accompanying Drawings which, however, are presented for illustrative purpose.

DETAILED DESCRIPTION OF THE PREFERRED EMBODIMENTS

The present invention will now be explained in detail. The present invention provides a process for the production of practical permanent magnets based on FeBR on an industrial scale.

In accordance with the present invention, the alloy powders of FeBR base compositions are first prepared.

While the present invention will be described essentially with respect to the anisotropic permanent magnets, it is understood that the present invention is not limited thereto, and can alike be applied to the isotropic permanent magnets.

Figure 1:
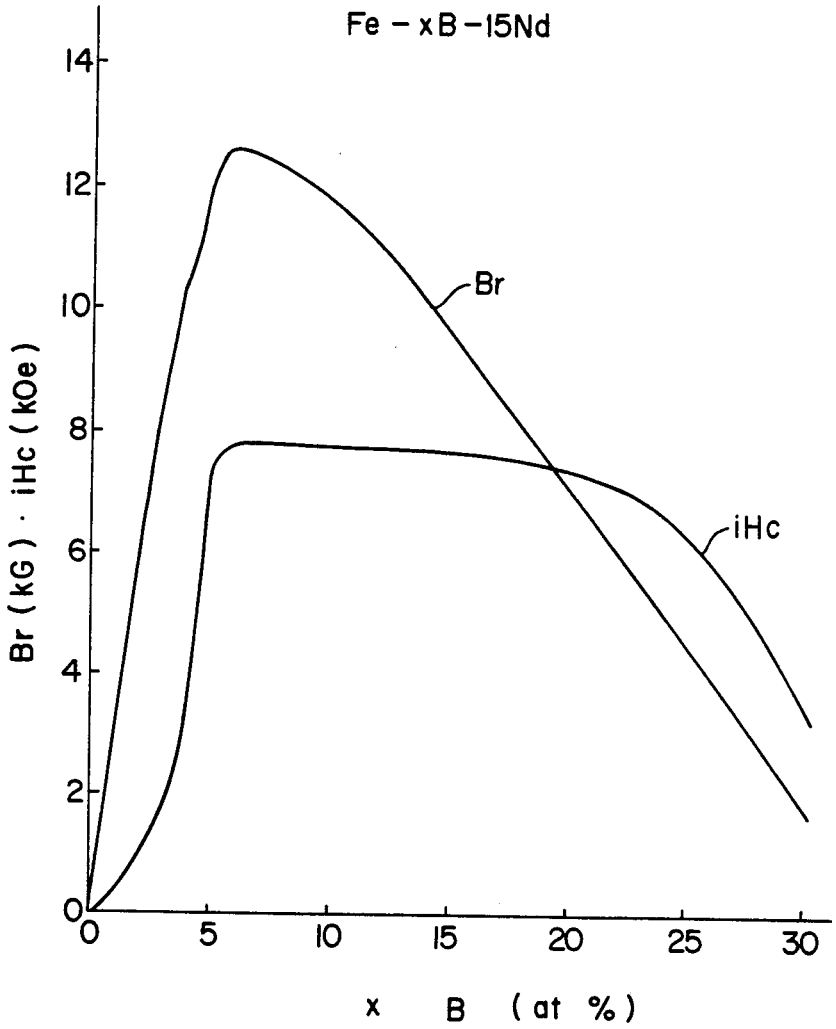
FIG. 1 is a graph showing changes of Br and iHc depending upon the amount of B (x at %) in a system of (85-x)Fe-xB-15Nd.
Figure 2:
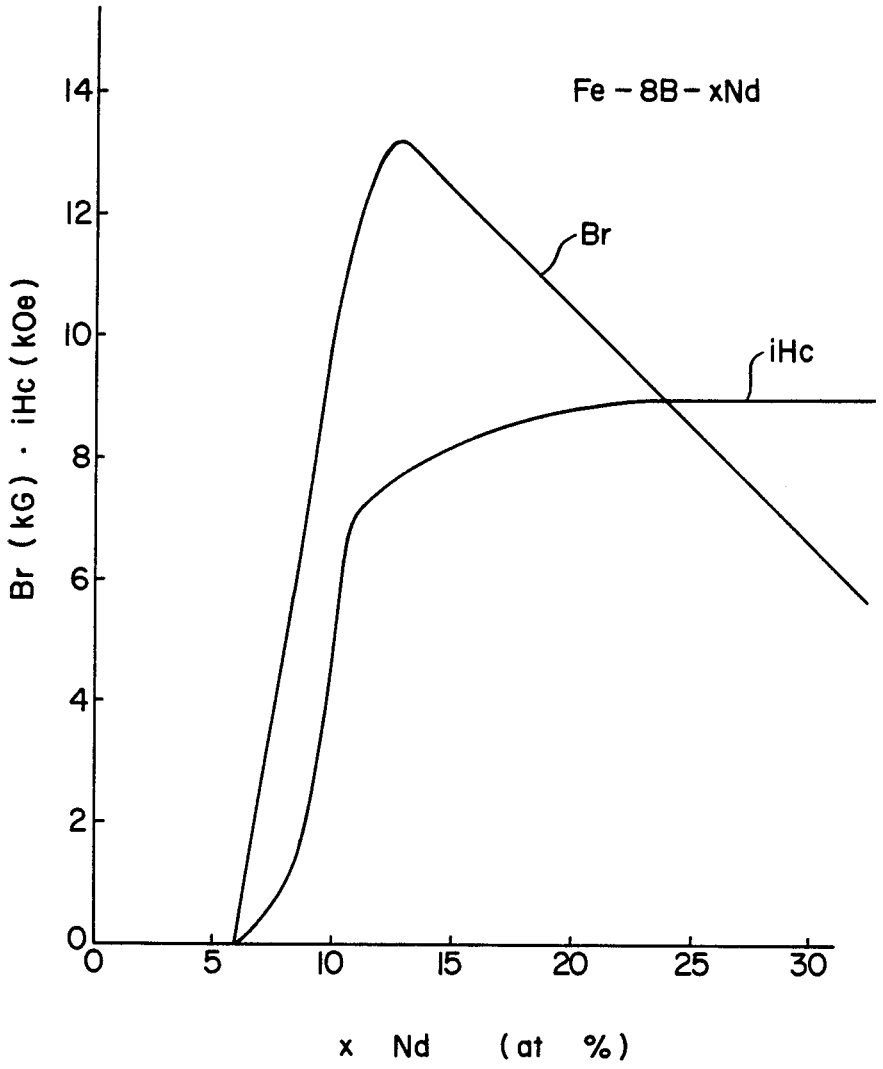
FIG. 2 is a graph showing changes of Br and iHc depending upon the amount of Nd (x at %) in a system of (92-)xFe-8B-xNd.

As illustrated in FIG. 1 showing (85-x)Fe-xB-15Nd as an example, the amount of B to be used in the present invention should be no less than 2 at % in order to comply with a coercive force, iHc, of 1 kOe or more required for permanent magnets, and no more than 28% in order to exceed the residual magnetic flux density, Br, of hard ferrite which is found to be 4 kG. Hereinafter, % means atomic % unless otherwise specified. The more the amount of R, the higher the iHc and, hence, the more favorable results are obtained for permanent magnets. However, the amount of R has to be no less than 8% to allow iHc to exceed 1 kOe, as will be appreciated from FIG. 2 showing (92-x)Fe-8B-xd as an example. However, the amount of R is preferably no more than 30%, since the powders of alloys having a high R content are easy to burn and difficult to handle due to the susceptibility of R to oxidation.

Boron B used in the present invention may be pure- or ferro-boron, and may also contain impurities such as Al, Si and C. As the rare earth elements represented by R use is made of one or more of light and heavy rare earth elements including Y. In other words, R includes Nd, Pr, La, Ce, Tb, Dy, Ho, Er, Eu, Sm, Gd, Pm, Tm, Yb, Lu and Y. The use of light rare earth as R may suffice for the present invention, but particular preference is given to Nd and/or Pr. The use of one rare earth element as R may also suffice, but admixtures of two or more elements such as mischmetal and didymium may be used due to their ease in availability and like factors. Sm, Y, La, Ce, Gd and so on may be used in combination with other rare earth elements, particularly Nd and/or Pr. The rare earth elements R are not always pure elements, and may contain impurities which are inevitably entrained in the course of production, as long as they are commercially available.

As the starting materials alloys of any componental elements Fe, B and R may be used.

The permanent magnet materials of the present invention permit the presence of impurities which are inevitably entrained in the course of production, and may contain C, S, P, Cu, Ca, Mg, O, Si, etc. within the predetermined limits. C may be derived from an organic binder, and S, P, Cu, Ca, Mg, O, Si and so on may originally be present in the starting materials or come from the course of production. The amounts of C, P, S, Cu, Ca, Mg, O and Si are respectively no more than 4.0%, 3.5%, 2.5%, 3.5%, 4.0%, 4.0%, and 2.0% and 5.0%, with the proviso that the combined amount thereof shall not exceed the highest upper limit of the elements to be actually contained. These upper limits are defined to obtain, (BH)max of at least 4 MGOe. For higher (BH)max, e.g., 20 MGOe, the limits are set, particularly for Cu, C and P, at each no more than 2%. It is noted in this connection that the amounts of P and Cu each are preferably no more than 3.3% in the case of the isotropic permanent magnets (materials) for obtaining (BH)max of 2 MGOe or more.

A composition comprising, by atomic percent, 8 to 30% R representing at least one of rare earth elements inclusive of Y, 2 to 28% B and the balance being Fe with inevitable impurities, provides permanent magnet materials of the present invention with magnetic properties as expressed in terms of a coercive force, iHc, of 1 kOe or more and a residual magnetic flux density, Br, of 4 kG or more, and exhibits a maximum energy product, (BH)max, on the order of 4 MGOe, that is equivalent to that of hard ferrite, or more. It is preferred that the permanent magnet materials comprises of 11 to 24% R composed mainly of light rare earth elements (namely, the light rare earth elements amount to 50% or more of the entire R), 3 to 27% B and the balance being Fe with impurities, since a maximum energy product, (BH)max, of 7 MGOe or more is achieved. It is more preferred that the permanent magnet materials comprises 12 to 20% R composed mainly of light rare earth elements, 4 to 24% B and the balance being Fe with impurities, since a maximum energy product, (BH)max, of 10 MGOe or more is then obtained. Still more preferred is the amounts of 12.5–20% R and 4–20% B for (BH)max of 20 MGOe or more, most preferred is the amounts of 13–19% R and 5–11% B for (BH)max of 30 MGOe or more.

The permanent magnet materials of the present invention are obtained as sintered bodies, and the process of their preparation essentially involves powder metallurgical procedures.

Typically, the magnetic materials of the present invention may be prepared by the process constituting the previous stage of the forming and sintering process for the preparation of the permanent magnets of the present invention. For example, various elemental metals are melted and cooled under such conditions that yield substantially crystalline state (no amorphous state), e.g., cast into alloys having a tetragonal system crystal structure, which are then finely ground into fine powders.

As a material for preparing the magnetic material use may be made of the powdery rare earth oxide $R_2O_3$ (a raw material for R). This may be heated with, e.g., powdery Fe, powdery FeB and a reducing agent (Ca, etc.) for direct reduction (optionally also with powdery Co). The resultant powder alloys show a tetragonal system as well.

Figure 4:
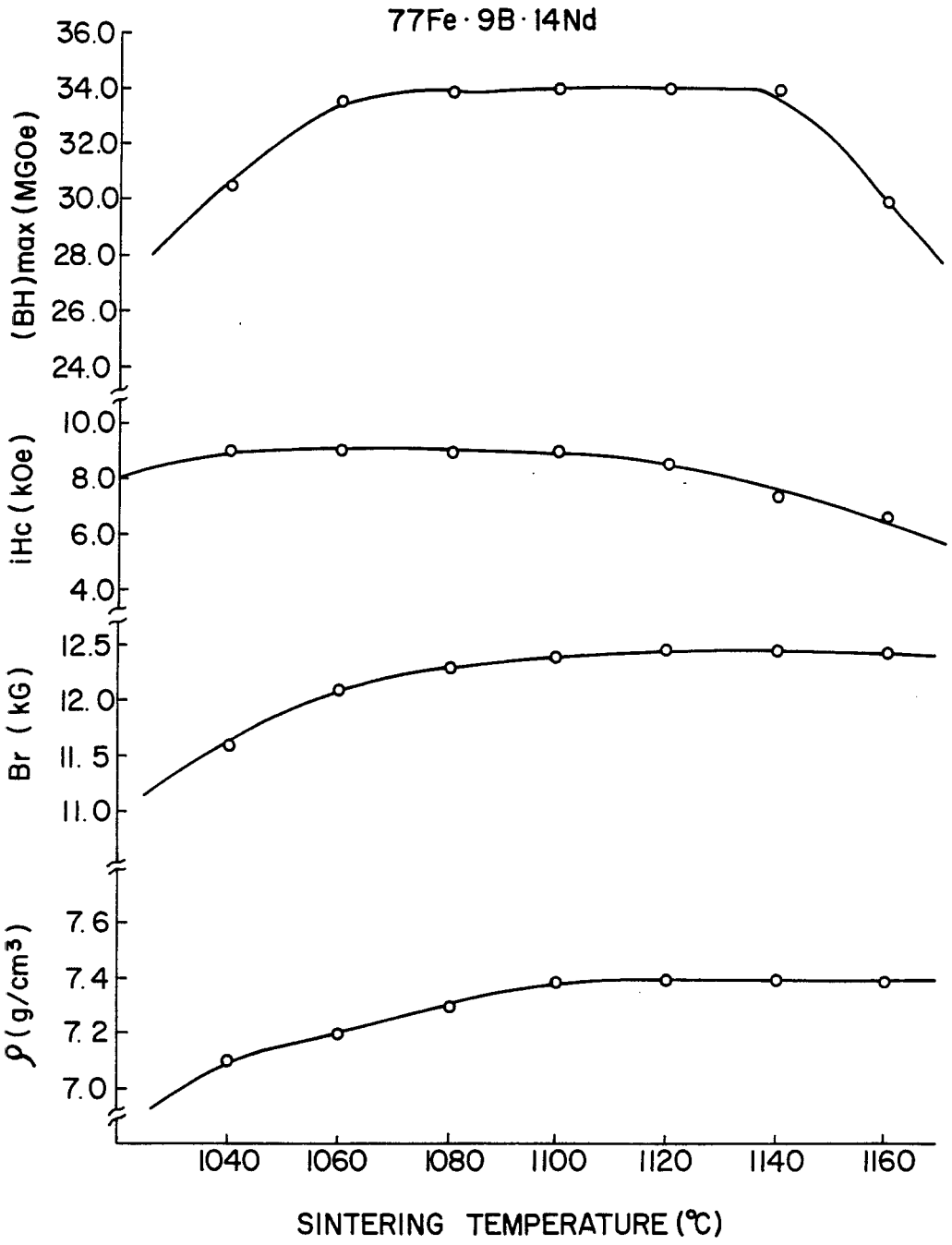
FIG. 4 is a graph showing the relationship of the sintering temperature with the magnetic properties and the density for an Fe-B-R basic system.

In view of magnetic properties, the density of the sintered bodies is preferably 95% or more of the theoretical density (ratio). As illustrated in FIG. 4, for instance, a sintering temperature of from 1060 to 1160 degrees C. gives a density of 7.2 g/cm$^3$ or more, which corresponds to 96% or more of the theoretical density. Furthermore, 99% or more of the theoretical density is reached with sintering of 1100 to 1160 degrees C. In FIG. 4, although density increases at 1160 degrees C., there is a drop of (BH)max. This appears to be attributable to coarser crystal grains, resulting in a reduction in the iHc and loop rectangularity ratio.

Figure 3:
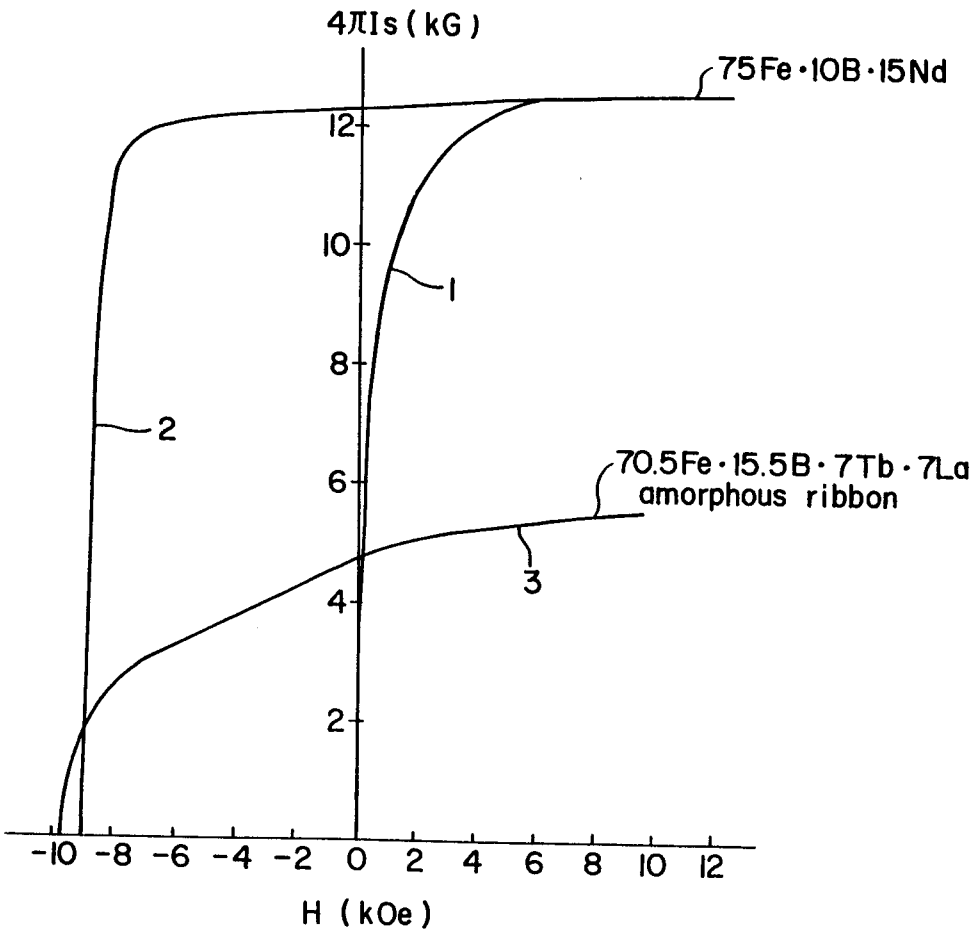
FIG. 3 is a graph showing a magnetization curves of a 75Fe-10B-15Nd magnet.

Referring to (anisotropic) 75Fe-10B-15Nd typical of the magnetic materials based on FeBR, FIG. 3 shows the initial magnetization curve 1 and the demagnetization curve 2 extending through the first to the second quadrant. The initial magnetization curve 1 rises steeply in a low magnetic field, and reaches saturation, and the demagnetization curve 2 has very high loop rectangularity. It is thought that the form of the initial magnetization curve 1 indicates that this magnet is a so-called nucleation type permanent magnet, the coercive force of which is determined by nucleation occurring in the inverted magnetic domain. The high loop rectangularity of the demagnetization curve 2 exhibits that this magnet is a typical high-performance magnet.

For the purpose of reference, there is shown a demagnetization curve 3 of a ribbon of a 70.75Fe-15.5B-7Tb-7La amorphous alloy which is an example of the known FeBR base alloys. (660 degrees C.$\times$15 min heat-treated. J. J. Beckev IEEE Transaction on Magnetics Vol. MAG-18 No. 6, 1982, p1451–1453.) The curve 3 shows no loop rectangularity whatsoever.

To enhance the properties of the permanent magnet materials of the present invention, the process of their preparation is essential.

The process of the present invention will now be explained in further detail.

In general, rare earth metals are chemically so vigorously active that they combine easily with atmospheric oxygen to yield rare earth oxides. Therefore, various steps such as melting, pulverization, forming (compacting), sintering, etc. have to be performed in a reducing or non-oxidizing atmosphere.

Figure 5:
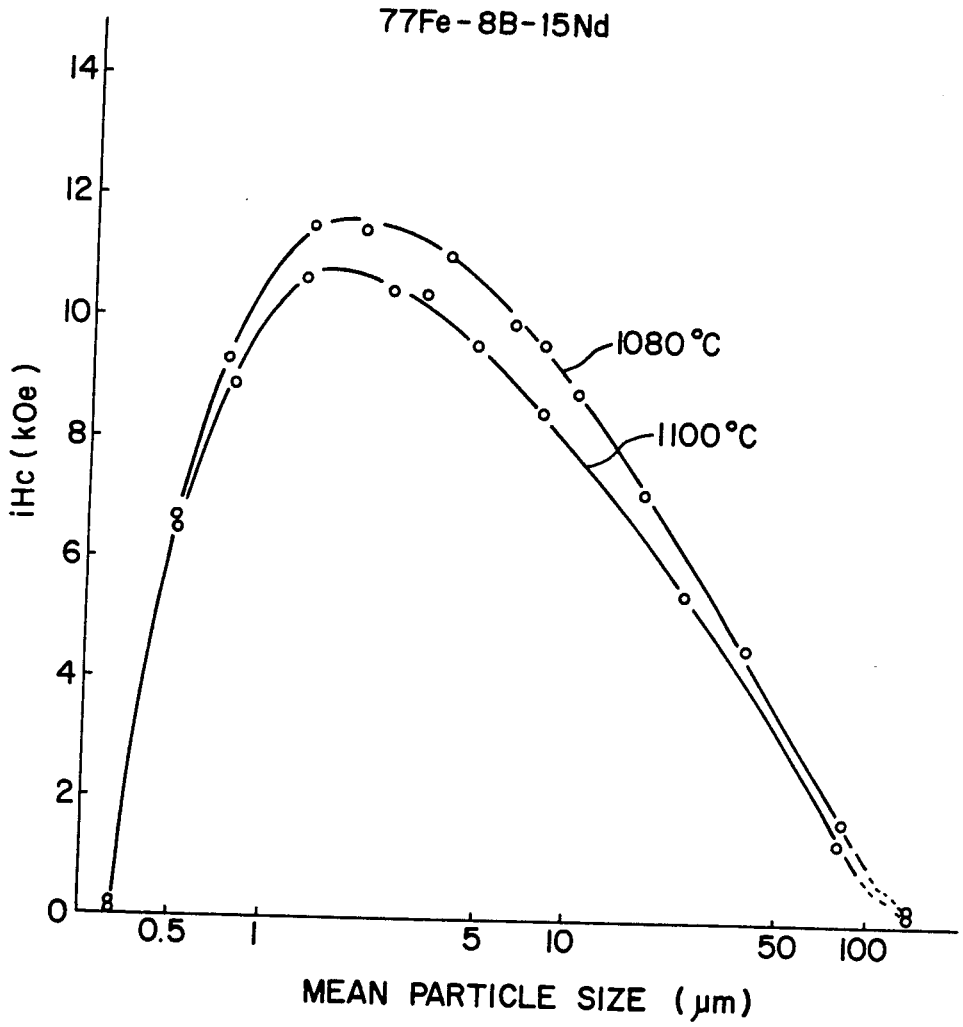
FIG. 5 is a graph showing the relationship between the mean particle size (microns) of alloy powders and iHc (kOe) for Fe-B-R basic systems.

First of all, the powders of alloys having a given composition are prepared. As an example, the starting materials are weighed out to have a given composition within the above-mentioned compositional range, and melted in a high-frequency induction furnace or like equipment to obtain an ingot which is in turn pulverized. Obtained from the powders having a mean particle size of 0.3 to 80 microns, the magnet has a coercive force, iHc, of 1 kOe or more (FIG. 5). A mean particle size of 0.3 microns or below is unpreferable for the stable preparation of high-performance products from the permanent magnet materials of the present invention, since oxidation then proceeds so rapidly that difficulty is encountered in the preparation of the end alloy. On the other hand, a mean particle size exceeding 80 microns is also unpreferable for the maintenance of the properties of permanent magnet materials, since iHc then drops to 1 kOe or below. When a mean particle size of from 40 to 80 microns is applied, there is a slight drop of iHc. Thus, a mean particle size of 1.0 to 40 microns is preferred, and a size of from 2 to 20 microns is most preferable to obtain excellent magnetic properties. Two or more types of powders may be used in the form of admixtures for the regulation of compositions or for the promotion of intimation of compositions during sintering, as long as they are within the above-mentioned particle size range and compositional range.

Also the ultimate composition may be obtained through modification of the base Fe-B-R alloy powders by adding minor amount of the componental elements or alloys thereof. This is applicable also for FeCoBR-, FeBRM-, and FeCoBRM systems wherein Co and/or M are part of the componental elements. Namely, alloys of Co and/or M with Fe, B and/or R may be used.

It is preferable that pulverization is of the wet type using a solvent. Used to this end are alcoholic solvents, hexane, trichloroethane, xylenes, toluene, fluorine base solvents, paraffinic solvents, etc.

Subsequently, the alloy powders having the given particle size are compacted preferably at a pressure of 0.5 to 8 Ton/cm$^2$. At a pressure of below 0.5 Ton/cm$^2$, the compacted mass or body has insufficient strength such that the permanent magnet to be obtained therefrom is practically very difficult to handle. At a pressure exceeding 8 Ton/cm$^2$, the formed body has increased strength such that it can advantageously be handled, but some problems arise in connection with the die and punch of the press and the strength of the die, when continuous forming is performed. However, it is noted that the pressure for forming is not critical. When the materials for the anisotropic permanent magnets are produced by forming-under-pressure, the forming-under-pressure is usually performed in a magnetic field. In order to align the particles, it is then preferred that a magnetic filed of about 7 to 13 kOe is applied. It is noted in this connection that the preparation of the isotropic permanent magnet materials is carried out by forming-under-pressure without application of any magnetic field.

The thus obtained formed body is sintered at a temperature of 900 to 1200 degrees C., preferably 1000 to 1180 degrees C.

When the sintering temperature is below 900 degrees C., it is impossible to obtain the sufficient density required for permanent magnet materials and the given magnetic flux density. A sintering temperature exceeding 1200 degrees C. is not preferred, since the sintered body deforms and the particles mis-align, thus giving rise to decreases in both the residual magnetic flux density, Br, and the loop rectangularity of the demagnetization curve. A sintering period of 5 minutes or more gives good results. Preferably the sintering period ranges from 15 minutes to 8 hours. The sintering period is determined considering the mass productivity.

Sintering is carried out in a reducing or non-oxidizing atmosphere. For instance, sintering is performed in a vacuum of $10^{-2}$ Torr, or in a reducing or inert gas of a purity of 99.9 mole % or more at 1 to 760 Torr. When the sintering atmosphere is an inert gas atmosphere, sintering may be carried out at a normal or reduced pressure. However, sintering may be effected in a reducing atmosphere or inert atmosphere under a reduced pressure to make the sintered bodies more dense. Alternatively, sintering may be performed in a reducing hydrogen atmosphere to increase the sintering density. The magnetically anisotropic (or isotropic) permanent magnet materials having a high magnetic flux density and excelling in magnetic properties can be obtained through the above-mentioned steps. For one example of the correlations between the sintering temperature and the magnetic properties, see FIG. 4.

While the present invention has been described mainly with reference to the anisotropic magnet materials, the present invention is also applicable to the isotropic magnet materials. In this case, the isotropic materials according to the present invention are by far superior in various properties to those known so far in the art, although there is a drop of the magnetic properties, compared with the anisotropic materials.

It is preferred that the isotropic permanent magnet materials comprise alloy powders consisting of 10 to 25% R, 3 to 23% B and the balance being Fe with inevitable impurities, since they show preferable properties.

The term "isotropic" used in the present invention means that the magnet materials are substantially isotropic, i.e., in a sense that no magnetic fields are applied during forming. It is thus understood that the term "isotropic" includes any magnet materials exhibiting isotropy as produced by pressing. As is the case with the anisotropic magnet materials, as the amount of R increases, iHc increases, but Br decreases upon showing a peak. Thus the amount of R ranges from 10 to 25% inclusive to comply with the value of (BH)max of 2 MGOe or more which the conventional isotropic magnets of alnico or ferrite. As the amount of B increases, iHc increases, but Br decreases upon showing a peak. Thus the amount of B ranges from 3 to 23% inclusive to obtain (BH)max of 2 MGOe or more.

The isotropic permanent magnets of the present invention show high magnetic properties exemplified by a high (BH)max on the order of 4 MGOe or more, if comprised of 12 to 20% R composed mainly of light rare earth (amounting to 50 at % or more of the entire R), 5 to 18% B and the balance being Fe. It is most preferable that the permanent magnets comprised of 12 to 16% R composed mainly of light rare earth such as Nd and Pr, 6 to 18% B and the balance being Fe, since it is then possible to obtain the highest properties ever such as (BH)max of 7 MGOe or more.

The present invention will now be explained with reference to the following non-restrictive examples.

The samples used in the examples were generally prepared through the following steps.

(1) The starting rare earth used had a purity, by weight ratio, of 99% or higher and contained mainly other rare earth metals as impurities. In this disclosure, the purity is given by weight. As iron and boron use was made of electrolytic iron having a purity of 99.9% and ferroboron containing 19.4% of B and as impurities Al and Si, respectively. The starting materials were weighed out to have the predetermined compositions.

(2) The raw material for magnets was melted by high-frequency induction. As the crucible, an alumina crucible was used. The obtained melt was cast in a water-cooled copper mold to obtain an ingot.

(3) The thus obtained ingot was crushed to −35 mesh, and subsequently finely pulverized in a ball mill until powders having a particle size of 0.3 to 80 microns were obtained.

(4) The powders were compacted at a pressure of 0.5 to 8 Ton/cm$^2$ in a magnetic field of 7 to 13 kOe. However, no magnetic field was applied in the case of the production of isotropic magnets.

(5) The compacted body was sintered at a temperature of 900 to 1200 degrees C. Sintering was then effected in a reducing gas or inert gas atmosphere, or in vacuo for 15 minutes to 8 hours.

The embodiments of the sintered bodies obtained through above-mentioned steps are shown in Table 1.

As will be understood from the embodiments, the FeBr base permanent magnets of high performance and any desired size can be prepared by the powder metallurgical sintering procedures according to the present invention. It is also possible to attain excellent magnetic properties that are by no means obtained through the conventional processes such as sputtering or melt-quenching. Thus, the present invention is industrially very advantageous in that the FeBR base high-performance permanent magnets of any desired shape can be prepared inexpensively.

These FeBR base permanent magnets have usually a Curie point of about 300 degrees C. reaching 370 degrees C. at the most, as disclosed in U.S. Patent Application Ser. No. 510,234 filed on July 1, 1983 based on Japanese Patent Application No. 57-145072. However, it is still desired that the Curie point be further enhanced.

As a result of detailed studies, it has further been found that the temperature-depending properties of such FeBR base magnets can be improved by adding Co to the permanent magnet materials based on FeBR ternary systems, provided that they are within a constant compositional range and produced by the powder metallurgical procedures under certain conditions. In addition, it has been noted that such FeBR base magnets do not only show the magnetic properties comparable with, or greater than, those of the existing alnico, ferrite and rare earth magnets, but can also be formed into any desired shape and practical size.

Figure 6:
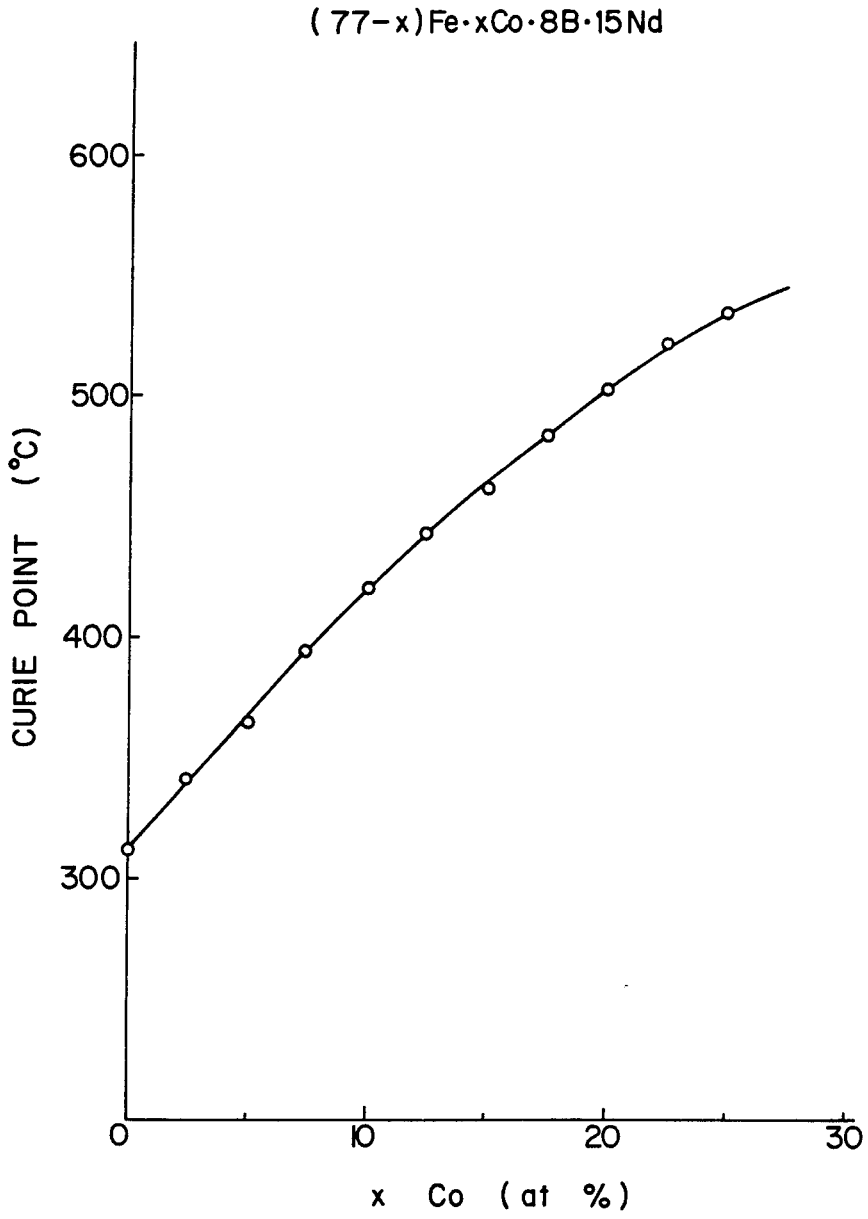
FIG. 6 is a graph showing the relationship between the Co amount (at %) and the Curie point Tc for a system (77-x)Fe-xCo-8B-15Nd.

In general, Co additions to alloy systems cause complicated and unpredictable results in respect to the Curie point and, in some cases, may bring about a drop of that point. In accordance with the present invention, it has been revealed that the Curie points of the FeBR base alloys (magnets) can be increased by substituting a part of the iron, a main component thereof, with Co (refer to FIG. 6).

In the FeBR base alloys, similar tendencies were observed regardless of the type of R. Even when used in a slight amount of, e.g., 1%, Co serves to increase Tc. Alloys having any Tc ranging from about 300 to 750 degrees C. can be obtained depending upon the amount of Co to be added. (The Co incorporation provides similar effect in the FeCoBRM system, see FIG. 14).

Due to the presence of Co, the permanent magnets of the present invention show the temperature-depending properties equivalent with those of the existing alnico and RCo base magnets and, moreover, offer other advantages. In other words, high magnetic properties can be attained by using as the rare earth elements R light rare earth such as relatively abundant Nd and Pr. For this reason, the Co-containing magnets based on FeBR according to the present invention are advantageous over the conventional RCo magnets from the standpoints of both resource and economy, and offer further excellent magnetic properties.

Whether anisotropic or isotropic, the present permanent magnets based essentially on FeBR can be prepared by the powder metallurgical procedures, and comprise sintered bodies.

Basically, the combined composition of B, R and (Fe+Co) of the FeCoBR base permanent magnets of the present invention is similar to that of the FeBR base alloys (free from Co).

Comprising, by atomic percent, 8 to 30% R, 2 to 28% R, 50% or less Co and the balance being Fe with inevitable impurities, the permanent magnets of the present invention show magnetic properties exemplified by a coercive force, iHc, of 1 kOe or more and a residual magnetic flux density, Br, of 4 kG or more, and exhibit a maximum energy product, (BH)max, equivalent with, or greater than, 4 MGOe of hard ferrite.

Figure 7:
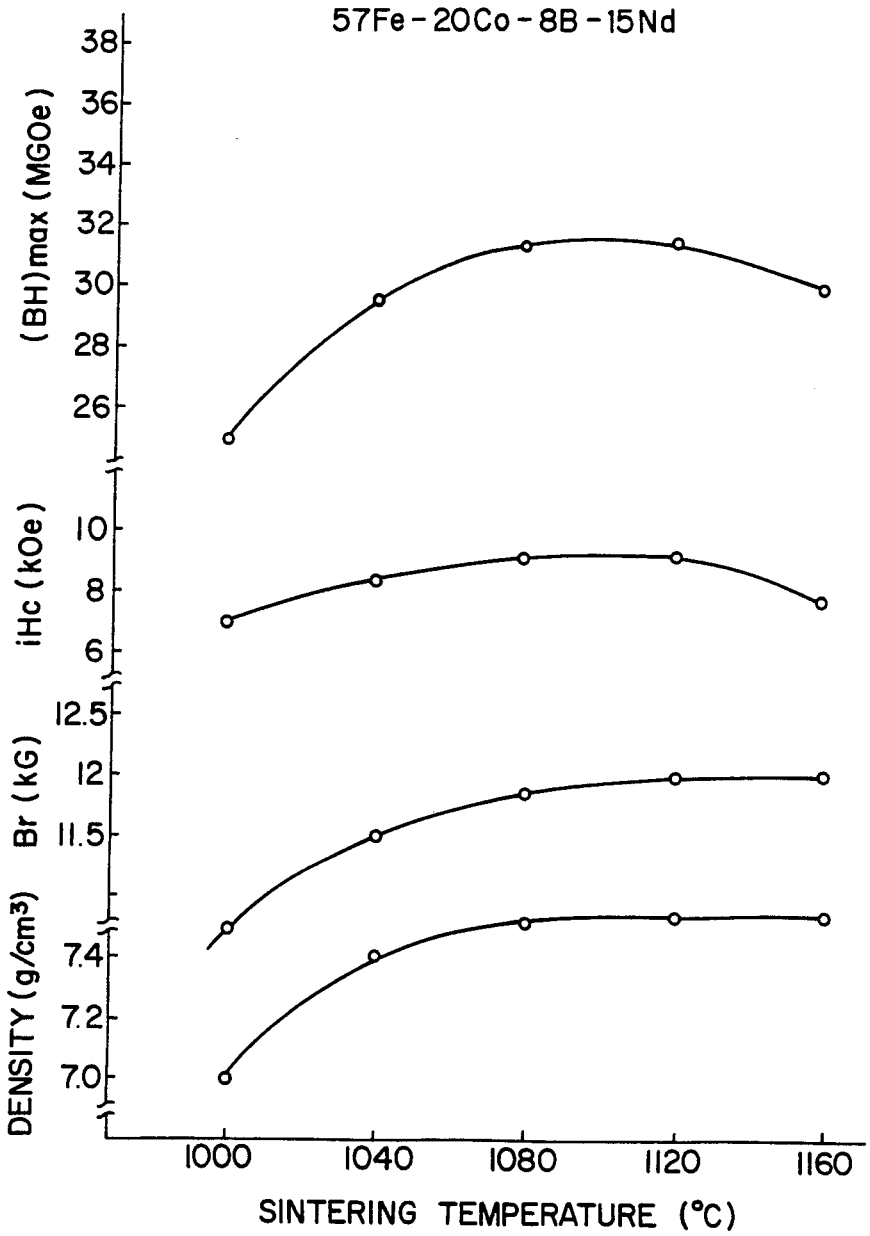
FIG. 7 is a graph showing the relationship of the sintering temperature with the magnetic properties and the density for an Fe-Co-B-R system.
Figure 8:
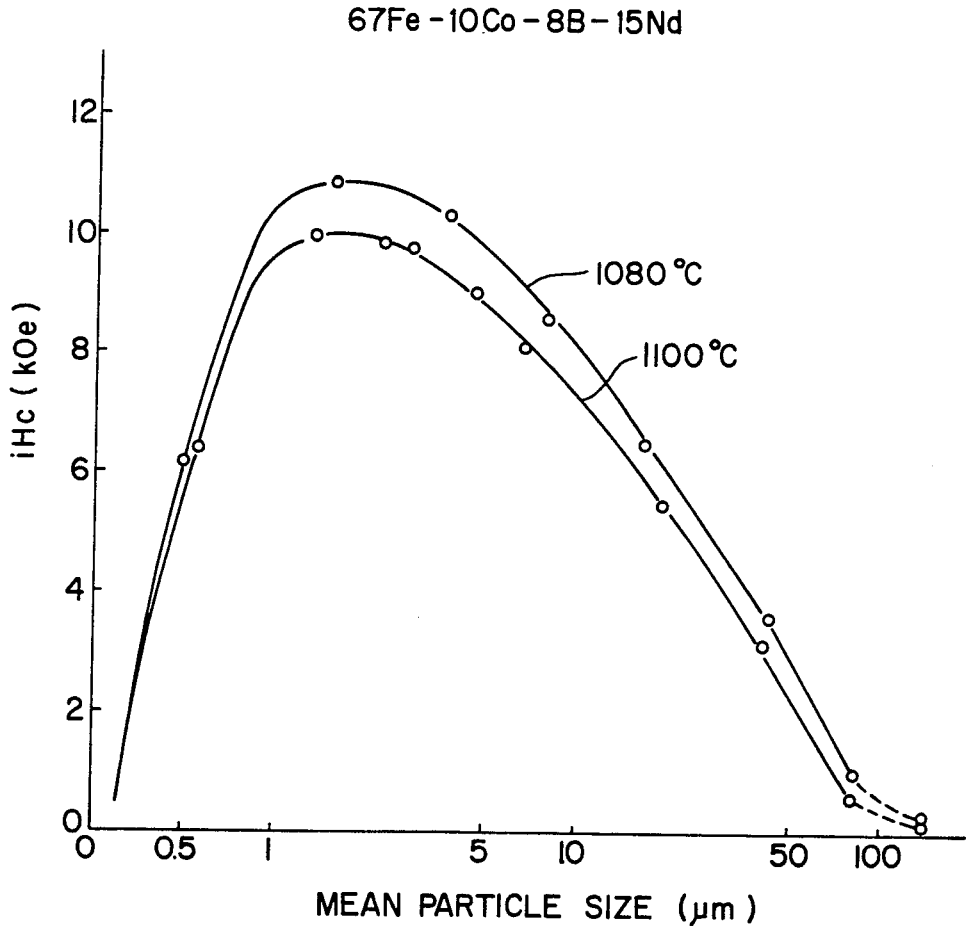
FIG. 8 is a graph showing the relationship between the mean particle size (microns) of alloy powders and iHc for Fe-Co-B-R systems.

Table 2 shows the embodiments of the FeCoBR base sintered bodies as obtained by the same procedures as applied to the FeBR base magnet materials, and FIG. 7 illustrates one embodiment for sintering.

Like the FeBR systems, the isotropic magnets based on FeCoBR exhibit good properties (see Table 2(6)).

As stated in the foregoing examples, the FeCoBR base permanent magnets materials according to the present invention can be formed into high-performance permanent magnets of practical Curie points as well as any desired shape and size.

Recently, the permanent magnets have increasingly been exposed to severe environments—strong demagnetizing fields incidental to the thinning tendencies of magnets, strong inverted magnetic fields applied through coils or other magnets, and high temperatures incidental to high processing rates and high loading of equipment—and, in many applications, need to possess higher and higher coercive forces for the stabilization of their properties.

Figure 12:
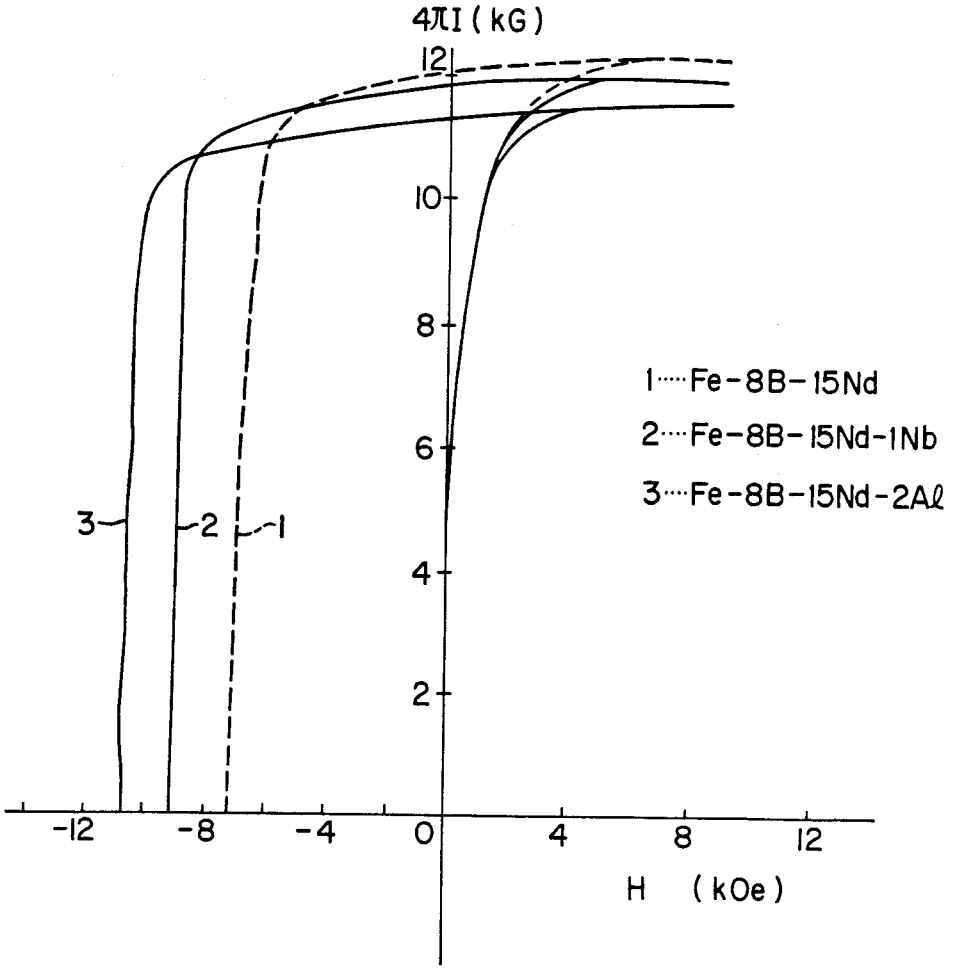
FIG. 12 is a graph showing initial magnetization and demagnetization curves for Fe-B-R and Fe-B-R-M systems.
Figure 13:
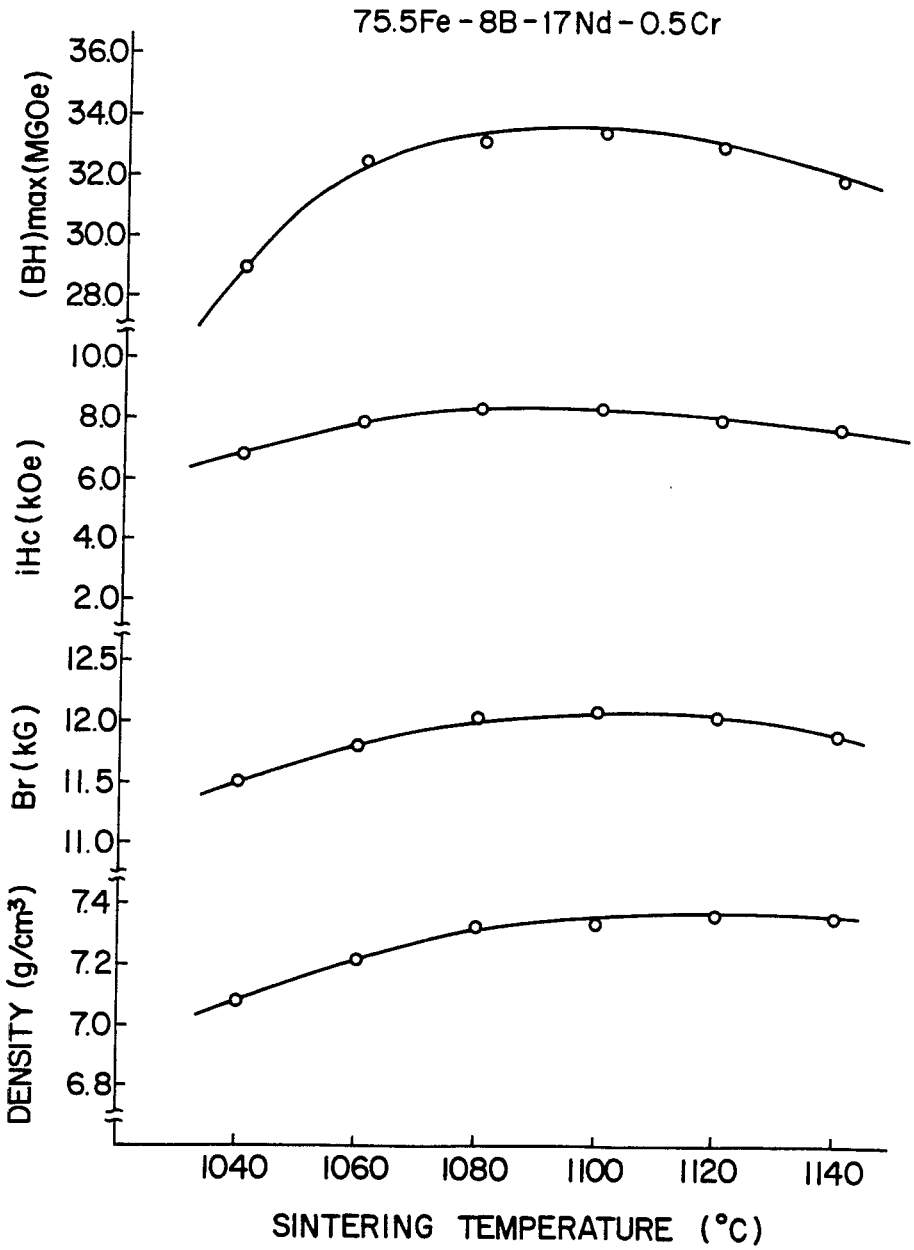
FIG. 13 is a graph showing the relationship of the sintering temperature with magnetic properties and the density for an Fe-B-R-M system.

Owing to the inclusion of one or more of the aforesaid certain additional elements M, the permanent magnets based on FeBRM can provide iHc higher than do the ternary permanent magnets based on FeBR (see FIG. 12). However, it has been revealed that the addition of these elements M causes gradual decreases in residual magnetization, Br, when they are actually added. Consequently, the amount of the elements M should be such that the residual magnetization, Br, is at least equal to that of hard ferrite, and a high coercive forced is attained.

Figure 9:
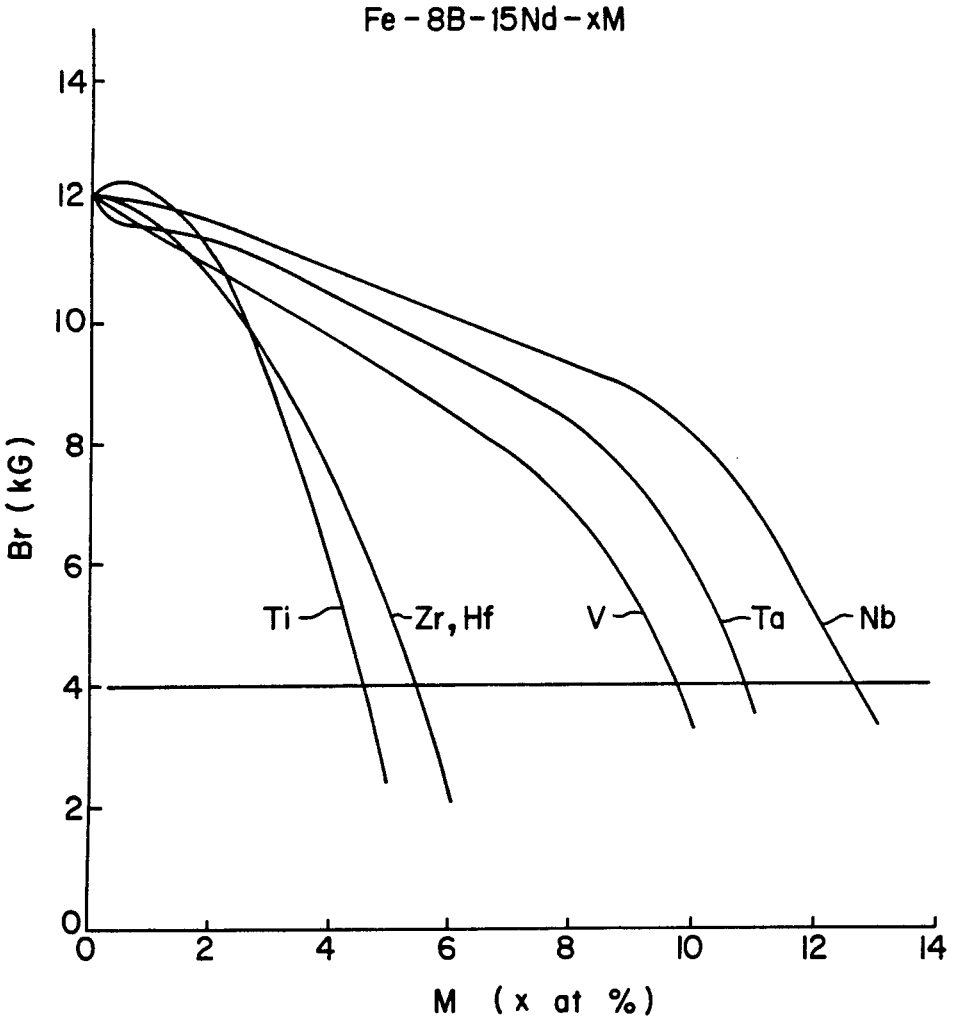
FIGS. 9–11 are graphs showing the relationship between the amount of additional elements M (x at %) and Br (kG) for an Fe-Co-B-M system.
Figure 10:
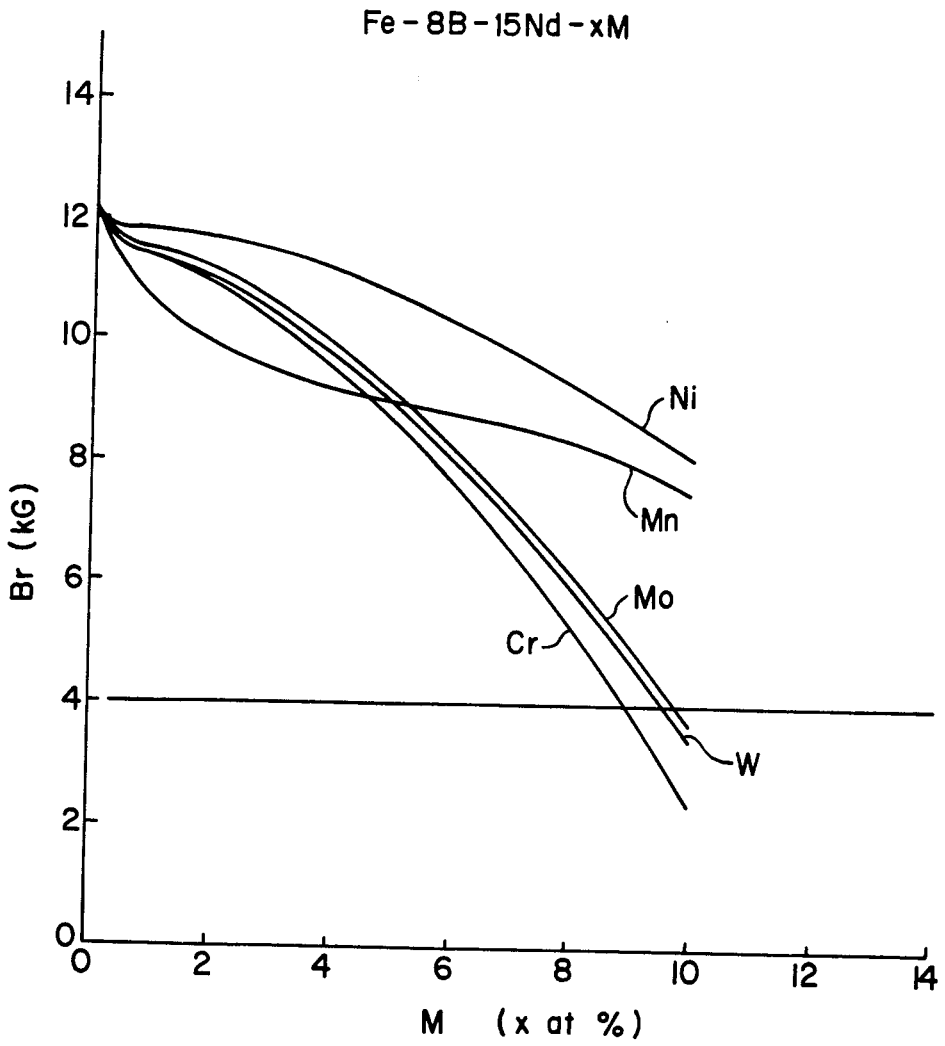
Figure 11:
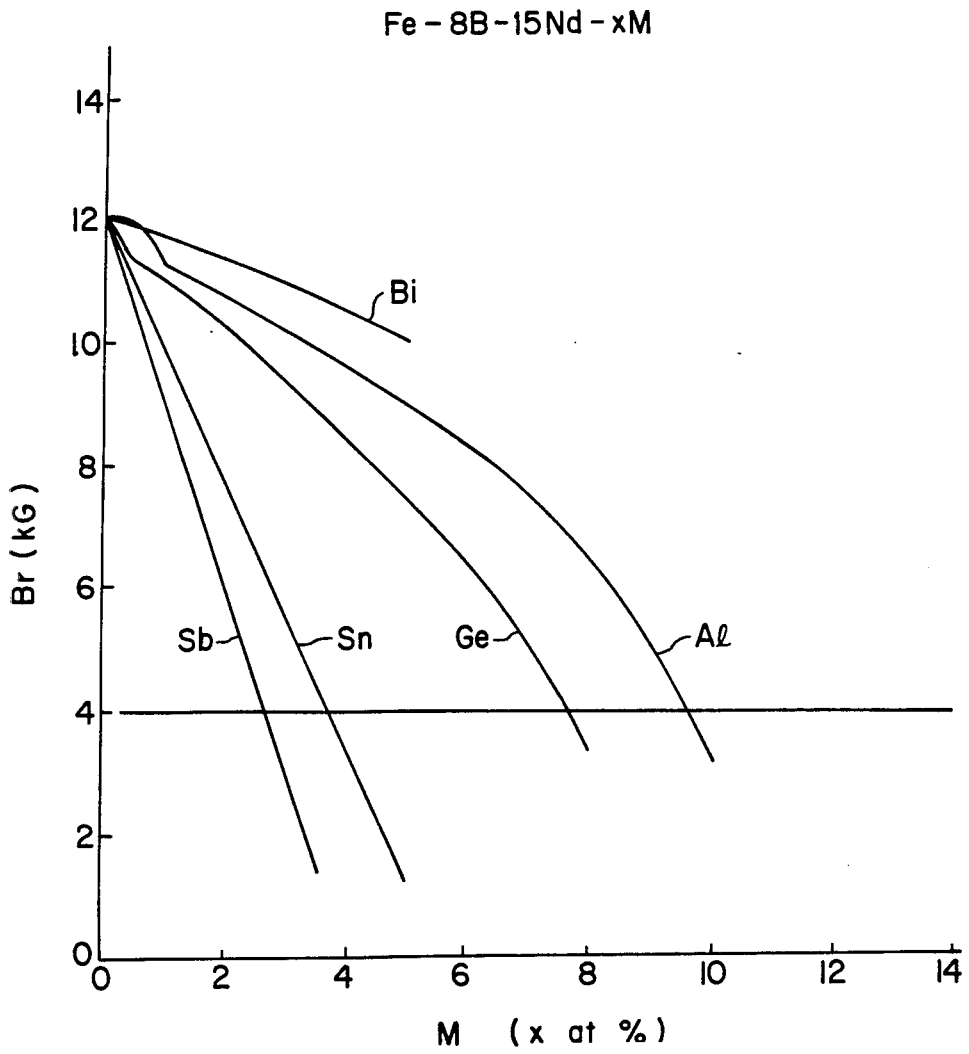

To make clear the effect of the individual elements M, the changes in Br were experimentally examined in varied amounts thereof. The results are shown in FIGS. 9 to 11. As illustrated in FIGS. 9 to 11, the upper limits of the amounts of additional elements M (Ti, V, Nb, Ta, Cr, Mo, W, Al, Sb, Ge, Sn, Zr, Hf) other than Bi, Mn and Ni are determined such that Br equal to, or greater than, about 4 kG of hard ferrite is obtained. The upper limits of the respective elements M are given below:

| | | |
|---|---|---|
| 4.5% Ti, | 8.0% Ni, | 5.0% Bi, |

-continued

| | | |
|---|---|---|
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.07% Ge, | 3.5% Sn, | 5.5% Zr, |
| and 5.5% Hf. | | |

Further preferably upper limits can clearly be read from FIGS. 9 to 11 by dividing Br into several sections such as 6.5, 8, 9, 10 kG and so on. E.g., Br of 9 kG or more is necessary for obtaining (BH)max of 20 MGOe or more.

Addition of Mn and Ni in larger amounts decreases iHc, but there is no appreciable drop of Br due to the fact that Ni is a ferromagnetic element. For this reason, in view of iHc, the upper limit of Ni is 8%, preferably 6.5%.

The influence of Mn addition upon the decrease in Br is larger than the case with Ni, but not strong. In view of iHc, the upper limit of Mn is thus 8%, preferably 6%.

The upper limit of Bi is fixed at 5%, since it is indeed impossible to produce alloys having a Bi content of 5% or higher due to the high vapor pressure of Bi. In the case of alloys containing two or more of the additional elements, it is required that the sum thereof be no more than the maximum value (%) among the upper limits of the elements to be actually added.

Within the compositional range of FeBRM as mentioned above, for instance, the starting materials were weighed out to have a composition of 15 at % Nd, 8 at % B, 1 at % V and the balance being Fe, and melted and cast into an ingot. The ingot was pulverized according to the procedures as mentioned above, formed at a pressure of 2 Ton/cm$^2$ in a magnetic field of 10 kOe, and sintered at 1080 degrees C. and 1100 degrees C. for 1 hour in an argon atmosphere of 200 Torr.

The relationship between the particle size of the powder upon pulverization and the coercive force, iHc, of the sintered body is substantially the same as illustrated in FIG. 5.

The results are shown in Table 3, from which it is found that the FeBRM base permanent magnet materials are industrially very advantageous in that they can be formed into the end products of high performance and any desired size by the powder metallurgical procedures according to the present invention, and can industrially be produced inexpensively in a stable manner.

It is noted that no magnets of high performance and any desired shape can be obtained by the prior art sputtering or melt-quenching.

According to the other aspects of the present invention, improvements in iHc are in principle intended by adding said additional elements M to FeCoBR quaternary systems as is the case with the FeBR ternary systems. The coercive force, iHc, generally decreases with increases in temperature, but, owing to the inclusion of M, the materials based on FeBR are allowed to have a practically high Curie point and, moreover, to possess magnetic properties equivalent with, or greater than, those of the conventional hard ferrite.

In the FeCoBRM quinary alloys, the compositional range of R and B are basically determined in the same manner as is the case with the FeCoBR quaternary alloys.

In general, when Co is added to Fe alloys, the Curie points of some alloys increase proportionately with the Co amount, while those of others drop, so that difficulty is involved in the prediction of the effect of Co addition.

Figure 14:
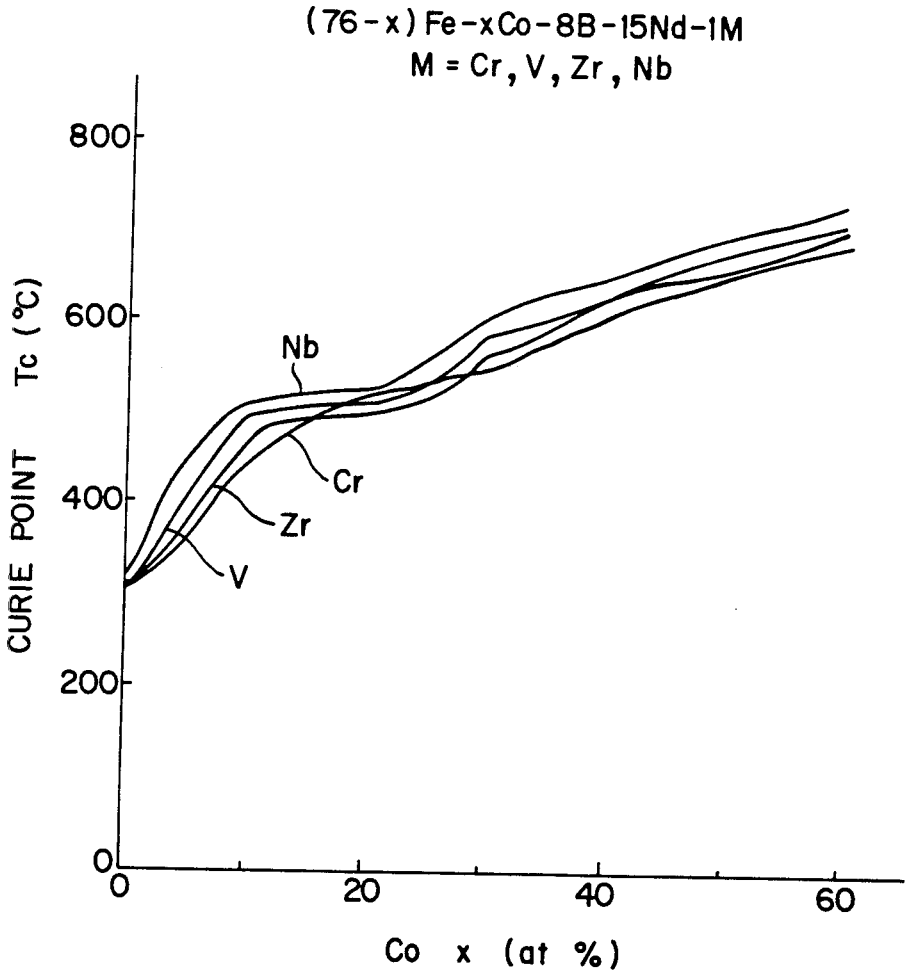
FIG. 14 is a graph showing the relationship between the Co amount (x at %) and the Curie point Tc for Fe-Co-B-Nd-M systems.

According to the present invention, it has been revealed that, when a part of Fe is substituted with Co, the Curie point increases gradually with increases in the amount of Co to be added, as illustrated in FIG. 14. Co is effective for increases in Curie point even in a slight amount. As illustrated in FIG. 14, alloys having any Curie point ranging from about 310 to about 750 degrees C. depending upon the amount of Co to be added can be achieved, e.g., a curie point of about 600° C. is achieved at 35% Co, about 625° C. at 40% Co, and about 650° C. at 45% Co.

When Co is contained in an amount of 25% or less, it contributes to increases in Curie points of the FeCoBRM systems without having an adverse influence thereupon, like also in the FeCoBR system. However, when the amount of Co exceeds 25%, there is a gradual drop of (BH)max, and there is a sharp drop of (BH)max in an amount exceeding 35%. This is mainly attributable to a drop of iHc of the magnets. When the amount of Co exceeds 50%, (BH)max drops to about 4 MGOe of hard ferrite. Therefore, the critical amount of Co is 50%. The amount of Co is preferably 35% or less, since (BH)max then exceeds 10 MGOe of the highest grade alnico and the cost of the raw material is reduced. The presence of 5% or more Co provides a thermal coefficient of Br of about 0.1%/degree C. or less. Co affords corrosion resistance to the magnets, since Co is superior in corrosion resistance to Fe.

Figure 15:
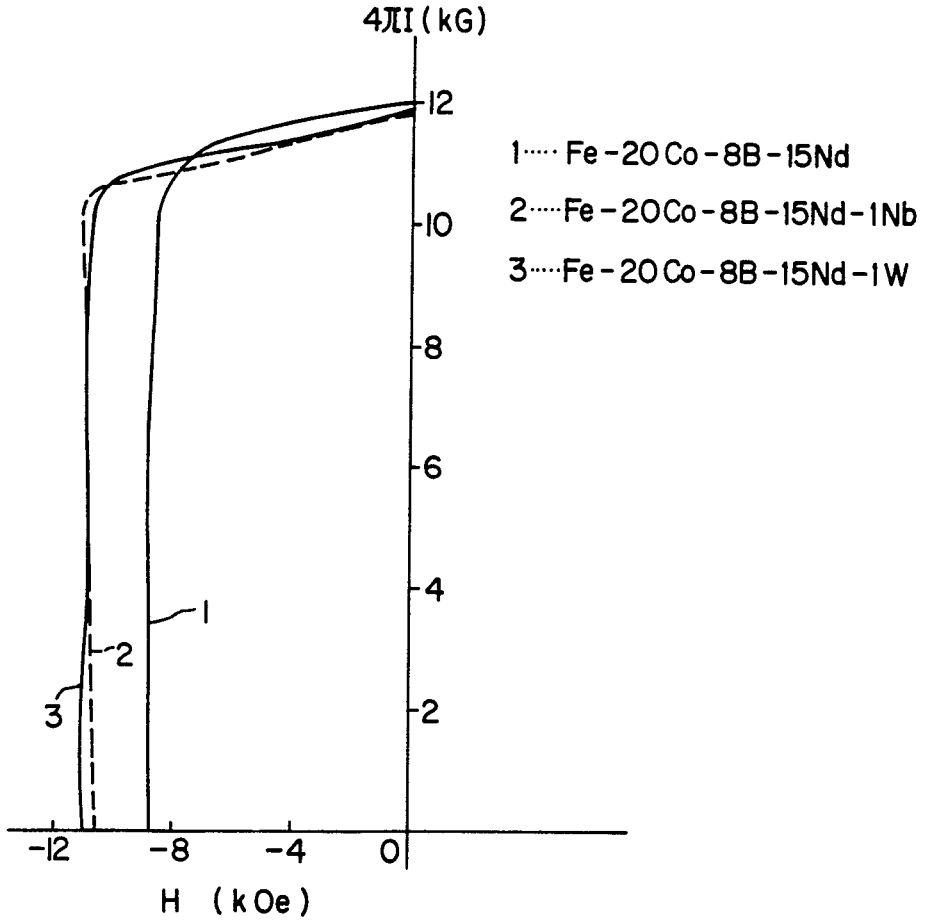
FIG. 15 is a graph showing demagnetization curves for typical Fe-Co-B-R and Fe-Co-B-R-M systems (abscissa H (kOe)).
Figure 16:
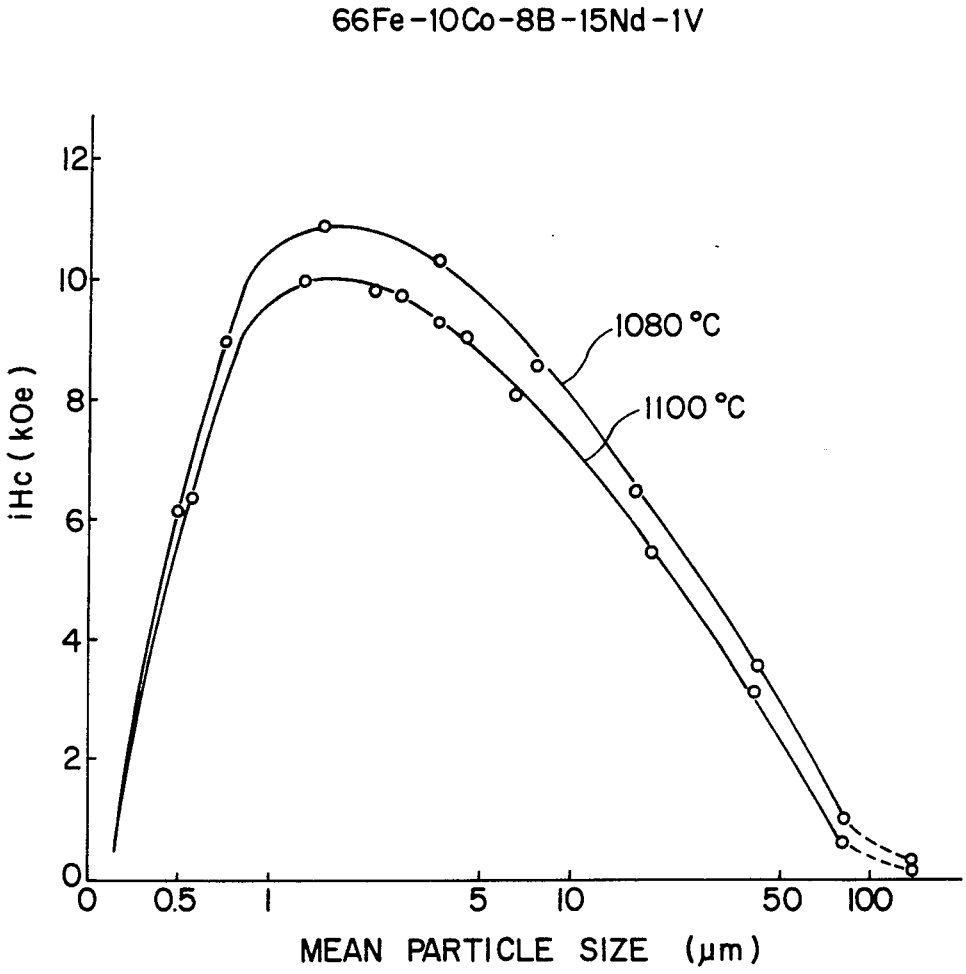
FIG. 16 is a graph showing the relationship between the mean particle size (microns) and iHc (kOe) for an Fe-Co-B-R-M system.
Figure 17:
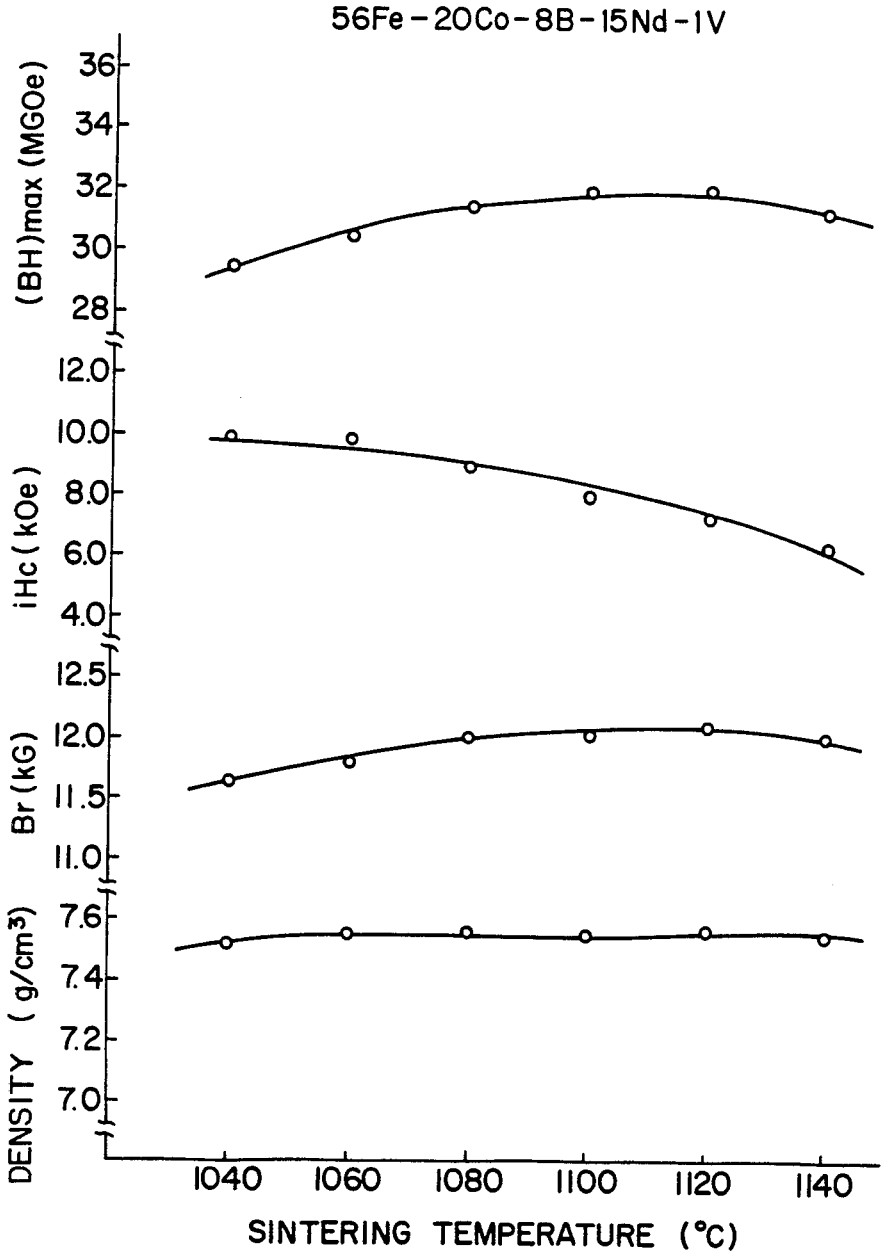
FIG. 17 is a graph showing the relationship of the sintering temperature with the magnetic properties and the density for an Fe-Co-B-R-M system.

Most of the M elements serve to increase the Hc of the magnets based on both FeBRM and FeCoBRM systems. Fig. 15 illustrates the demagnetization curves of typical examples of the FeCoBRM magnets and the FeCoBR magnets (free from M) for the purpose of comparison. An increase in iHc due to the addition of M leads to an increase in the stability of the magnets, so that they can find use in wider applications. However, since the M elements except Ni are non-magnetic elements, Br decreases with the resulting decreases in (BH)max, as the amount of M increases. Recently, there have been increasing applications for which magnets having slightly lower (BH)max but a high Hc are needed. Hence, M-containing alloys are very useful, as long as they possess a (BH)max of 4 MGOe or higher.

To make clear the effect of the additional elements M, the changes in Br were experimentally examined in varied amounts thereof. The results are substantially similar with those curves for the FeBRM systems as shown in FIGS. 9 to 11. As illustrated in FIGS. 9 to 11, the upper limits of the amounts of M are principally determined such that Br of about 4 kG which is equal to, or greater than, that of hard ferrite is obtained, as is the case with the FeBRM systems.

As seen from the foregoing examples, the FeCoBRM base permanent magnets can be formed into high-performance products of any desired size by the powder metallurgical procedures according to the present invention, and as will be appreciated from FIG. 7, no products of high performance and any desired shape can be obtained by the conventional sputtering or melt-quenching. Consequently, this embodiment is industrially very advantageous in that high-performance permanent magnets of any desired shape can be produced inexpensively.

The preferable ranges of B and R are also given as is the case with FeBR or FeBRM.

As the starting metallic powders for the forming (compacting) step, besides alloys with predetermined composition or a mixture of alloys within such compositions, any elemental metal or alloys of the componental elements including Fe, B, R, Co and/or additional elements M may be used for auxiliary material with a complemental composition making up the final compositions.

As exemplified hereinabove the sintering may be effected without applying mechanical force, however, other known sintering techniques such as sintering by applying force upon the mass to be sintered may be employed, too.

TABLE 1

| alloy composition (at %) | mean particle size (μm) | pressing pressure ton/cm$^2$ in magnetic field of 10 kOe | sintering atmosphere time |
|---|---|---|---|
| (1) 72Fe8B20Nd | 3.3 | 3 | Ar atm. pressure 1 hr |
| (2) 77Fe9B9Nd5Pr | 2.8 | 1.5 | 200 Torr 4 hr |
| (3) 77Fe7B16Pr | 4.9 | 5 | $1 \times 10^{-4}$ Torr vacuum 2 hr |
| (4) 79Fe7B14Nd | 5.2 | 1.5 | Ar atmosphere 1 hr |
| (5) 68Fe17B15Nd | 1.8 | 2 | Ar 200 Torr 2 hr |
| (6) 77Fe8B15Nd | 1.5 | no magnetic field 2 | Ar atmosphere 1 hr |

| alloy composition (at %) | sintering temperature 900° C. density g/cm$^2$ | 900° C. (BH) max (MGOe) | 1040° C. density g/cm$^2$ | 1040° C. (BH) max (MGOe) | 1120° C. density g/cm$^2$ | 1120° C. (BH) max (MGOe) | 1180° C. density g/cm$^2$ | 1180° C. (BH) max (MGOe) |
|---|---|---|---|---|---|---|---|---|
| (1) 72Fe8B20Nd | 6.0 | 9.5 | 7.1 | 23.5 | 7.4 | 26.0 | 7.4 | 22.0 |
| (2) 77Fe9B9Nd5Pr | 6.1 | 10.8 | 7.1 | 24.7 | 7.4 | 31.0 | 7.3 | 24.1 |
| (3) 77Fe7B16Pr | 5.7 | 10.0 | 7.1 | 24.5 | 7.3 | 22.0 | 7.3 | 10.5 |
| (4) 79Fe7B14Nd | 5.8 | 13.5 | 7.1 | 31.0 | 7.4 | 33.8 | 1200° C. 7.4 | 25.5 |
| (5) 68Fe17B15Nd | 5.8 | 6.2 | 7.2 | 16.5 | 7.3 | 19.0 | 7.3 | 15.5 |
| (6) 77Fe8B15Nd | 5.8 | 2.4 | 7.2 | 8.7 | 7.4 | 9.7 | 7.4 | 6.2 |

TABLE 2

| alloy composition (at %) | mean particle size (μm) | pressing pressure ton/cm$^2$ in magnetic field of 10 kOe | sintering atmosphere time |
|---|---|---|---|
| (1) 71Fe—5Co—7B—17Nd | 3.1 | 3 | Ar atm. pressure 1 hr |
| (2) 67Fe—10Co—9B—9Nd—5Pr | 3.5 | 1.5 | Ar 200 Torr 4 hr |

TABLE 2-continued

| | | | | |
|---|---|---|---|---|
| (3) | 57Fe—20Co—10B—13Nd | 5.2 | 1.5 | Ar atmosphere 1 hr |
| (4) | 65.5Fe—2.5Co—17B—15Nd | 2.8 | 2 | Ar 200 Torr 2 hr |
| (5) | 45Fe—30Co—10B—15Nd | 1.5 | 2 | Ar 200 Torr 2 hr |
| (6) | 67Fe—10Co—8B—15Nd | 2.0 | no magnetic field 2 | Ar atmosphere 1 hr |

| | | sintering temperature | | | | | | | |
|---|---|---|---|---|---|---|---|---|---|
| | | 900° C. | | 1040° C. | | 1100° C. | | 1160° C. | |
| | alloy composition (at %) | density g/cm$^2$ | (BH) max (MGOe) | density g/cm$^2$ | (BH) max (MGOe) | density g/cm$^2$ | (BH) max (MGOe) | density g/cm$^2$ | (BH) max (MGOe) |
| (1) | 71Fe—5Co—7B—17Nd | (950° C.) 6.0 | 13.0 | 7.3 | 30.1 | (1080° C.) 7.4 | 32.5 | 7.4 | 33.0 |
| (2) | 67Fe—10Co—9B—9Nd—5Pr | (950° C.) 6.0 | 11.5 | 7.3 | 29.5 | (1080° C.) 7.4 | 30.3 | 7.4 | 30.5 |
| (3) | 57Fe—20 Co—10B—13Nd | 6.0 | 13.5 | 7.4 | 28.0 | 7.5 | 31.0 | (1180° C.) 7.5 | 31.5 |
| (4) | 65.5Fe—2.5Co—17B—15Nd | 6.0 | 6.5 | 7.2 | 16.8 | 7.3 | 19.5 | (1180° C.) 7.3 | 15.5 |
| (5) | 45Fe—30Co—10B—15Nd | 6.0 | 10.5 | 7.3 | 28.0 | 7.4 | 28.3 | (1140° C.) 7.4 | 27.5 |
| (6) | 67Fe—10Co—8B—15Nd | 6.1 | 2.3 | 7.2 | 8.7 | 7.4 | 9.7 | (1140° C.) 7.4 | 6.2 |

TABLE 3

| | alloy composition (at %) | mean particle size (μm) | pressing pressure ton/cm$^2$ in magnetic field of 10 kOe | sintering atmosphere time |
|---|---|---|---|---|
| (1) | 76Fe—8B—15Nd—1Ti | 3 | 3 | Ar atm. pressure 2 hr |
| (2) | 73Fe—10B—15Nd—2V | 5 | 1.5 | vacuum $1 \times 10^{-4}$ Torr 1 hr |
| (3) | 76Fe—8B—15Nd—1Nb | 2 | 2 | Ar 200 Torr 1 hr |
| (4) | 74Fe—8B—17Nd—1Ta | 3 | 1.5 | Ar atm. pressure 3 hr |
| (5) | 75.5Fe—10B—14Nd—0.5Cr | 2.8 | 2 | vacuum $1 \times 10^{-4}$ Torr 4 hr |
| (6) | 76Fe—8B—15Nd—1Mo | 3.5 | 3 | Ar 60 Torr 2 hr |
| (7) | 75.5Fe—7B—17Nd—0.5W | 3.6 | 3 | Ar atm. pressure 1 hr |
| (8) | 76Fe—9B—14Nd—1Mn | 4.0 | 1.5 | Ar 200 Torr 2 hr |
| (9) | 76.5Fe—7B—16Nd—0.5Ni | 4.0 | 2 | $1 \times 10^{-4}$ Torr vacuum 1 hr |
| (10) | 76Fe—8B—15Nd—1Al | 2.5 | 1.5 | Ar 400 Torr 2 hr |
| (11) | 74.5Fe—9B—16Nd—0.5Ge | 3.5 | 7.5 | Ar atm. pressure 2 hr |
| (12) | 76Fe—9B—14Nd—1Sn | 4.0 | 2.5 | Ar 60 Torr 1 hr |
| (13) | 75Fe—9B—15Nd—1Sb | 3.1 | 1.5 | $1 \times 10^{-4}$ Torr vacuum 1.5 hr |
| (14) | 75Fe—7B—14Nd—1Bi | 2.1 | 2.5 | Ar 1 Torr 0.5 hr |
| (15) | 76Fe—8B—15Pr—1Al | 4.0 | 1.5 | Ar 200 Torr 2 hr |
| (16) | 73Fe—9B—15Nd—2Dy—1V | 3.1 | 2 | Ar 100 Torr 1 hr |
| (17) | 76Fe—8B—15Nd—1Al | 3.0 | no magnetic field 3 | Ar atm. pressure 1.1 hr |

| | | sintering temperature | | | | | | | |
|---|---|---|---|---|---|---|---|---|---|
| | | 900° C. | | 1000° C. | | 1080° C. | | 1160° C. | |
| | alloy composition (at %) | density g/cm$^2$ | (BH) max (MGOe) | density g/cm$^2$ | (BH) max (MGOe) | density g/cm$^2$ | (BH) max (MGOe) | density g/cm$^2$ | (BH) max (MGOe) |
| (1) | 76Fe—8B—15Nd—1Ti | 6.0 | 14.1 | 6.8 | 24.8 | 7.4 | 33.2 | 7.4 | 34.0 |
| (2) | 73Fe—10B—15Nd—2V | 5.9 | 11.3 | 6.7 | 21.0 | 7.3 | 28.0 | 7.4 | 28.0 |
| (3) | 76Fe—8B—15Nd—1Nb | 6.0 | 14.6 | 6.9 | 25.2 | 7.4 | 32.9 | 7.4 | 33.0 |
| (4) | 74Fe—8B—17Nd—1Ta | 6.1 | 10.8 | 7.0 | 23.5 | 7.6 | 29.5 | 7.6 | 29.0 |
| (5) | 75.5Fe—10B—14Nd—0.5Cr | 5.9 | 12.0 | 6.9 | 25.0 | 7.45 | 32.5 | 7.5 | 33.0 |
| (6) | 76Fe—8B—15Nd—1Mo | 5.9 | 13.5 | 6.8 | 23.5 | 7.4 | 31.0 | 7.4 | 31.5 |
| (7) | 75.5Fe—7B—17Nd—0.5W | 6.1 | 10.8 | 7.0 | 24.0 | 7.5 | 28.5 | 7.5 | 28.0 |
| (8) | 76Fe—9B—14Nd—1Mn | 5.9 | 12.4 | 6.9 | 23.6 | 7.45 | 29.0 | 7.5 | 29.5 |
| (9) | 76.5Fe—7B—16Nd—0.5Ni | 5.8 | 12.0 | 6.8 | 23.5 | 7.3 | 29.5 | 7.4 | 30.0 |
| (10) | 76Fe—8B—15Nd—1Al | 5.8 | 13.5 | 6.8 | 24.5 | 7.3 | 30.5 | 7.4 | 31.0 |
| (11) | 74.5Fe—9B—16Nd—0.5Ge | 5.8 | 10.8 | 6.7 | 19.5 | 7.2 | 25.5 | 7.4 | 27.0 |
| (12) | 76Fe—9B—14Nd—1Sn | 5.9 | 5.8 | 6.9 | 13.0 | 7.4 | 20.1 | 7.4 | 21.0 |
| (13) | 75Fe—9B—15Nd—1Sb | 5.8 | 8.5 | 7.0 | 13.0 | 7.4 | 20.5 | 7.4 | 20.5 |
| (14) | 75Fe—7B—14Nd—1Bi | 5.9 | 13.2 | 6.9 | 25.0 | 7.4 | 31.8 | 7.4 | 32.0 |
| (15) | 76Fe—8B—15Pr—1Al | 5.9 | 8.4 | 6.8 | 15.0 | 7.4 | 25.5 | 7.4 | 15.0 |
| (16) | 73Fe—9B—15Nd—2Dy—1V | 6.1 | 12.5 | 7.0 | 23.0 | 7.5 | 27.7 | 7.6 | 25.0 |
| (17) | 76Fe—8B—15Nd—1Al | 5.8 | 2.9 | 6.8 | 4.8 | 7.4 | 9.3 | 7.4 | 9.1 |

TABLE 4-1

| No. | alloy composition (at %) | mean particle size (μm) | pressing condition: pressure (ton/cm$^2$) | pressing condition: magnetic field (kOe) | sintering atmosphere (sintered for 1 hr) |
|---|---|---|---|---|---|
| 1 | Fe—10Co—8B—15Nd—1Al | 3.2 | 2 | 10 | Ar, 200 Torr |
| 2 | Fe—20Co—12B—16Nd—1Ti | 2.4 | 1.5 | 8 | Ar, atm. pressure |

TABLE 4-1-continued

| No. | alloy composition (at %) | mean particle size (μm) | pressing condition: pressure (ton/cm²) | pressing condition: magnetic field (kOe) | sintering atmosphere (sintered for 1 hr) |
|---|---|---|---|---|---|
| 3 | Fe—2Co—8B—16Nd—2V | 6.3 | 2.5 | 9 | vacuum $1 \times 10^{-4}$ Torr |
| 4 | Fe—20Co—8B—15Nd—1Cr | 2.8 | 3 | 10 | Ar, 60 Torr |
| 5 | Fe—2Co—8B—14Nd—0.5Mn | 3.0 | 2 | 7 | Ar, 200 Torr |
| 6 | Fe—5Co—8B—17Nd—1Zr | 3.5 | 4.0 | 12 | vacuum $1 \times 10^{-4}$ Torr |
| 7 | Fe—20Co—13B—14Nd—0.3Hf | 8.3 | 3.0 | 13 | $H_2$, 0.1 Torr |
| 8 | Fe—35Co—7B—15Nd—3Nb | 2.5 | 3.5 | 12 | Ar, 200 Torr |
| 9 | Fe—10Co—8B—15Nd—1Ta | 1.5 | 1.5 | 10 | Ar, 460 Torr |
| 10 | Fe—2Co—8B—15Nd—1W | 4.0 | 2.0 | 13 | vacuum $1 \times 10^{-4}$ Torr |
| 11 | Fe—20Co—13B—14Nd—1Mo | 3.3 | 2.5 | 10 | Ar, atm. pressure |
| 12 | Fe—20Co—8B—13Nd—0.3Ge | 3.8 | 2 | 12 | Ar, 200 Torr |
| 13 | Fe—10Co—9B—14Nd—0.5Sn | 1.5 | 3 | 11 | Ar, 1 Torr |
| 14 | Fe—5Co—8B—15Nd—0.2Bi | 3 | 2.5 | 13 | Ar, atm. Pressure |
| 15 | Fe—5Co—8B—15Nd—1Ni | 2.1 | 2.0 | 11 | Ar, 0.1 Torr |
| 16 | Fe—10Co—9B—14Pr—1W | 3.5 | 1.5 | 8 | vacuum $1 \times 10^{-4}$ Torr |
| 17 | Fe—5Co—7B—11Nd—4Dy—0.5Al | 2.3 | 2.0 | 10 | Ar, 200 Torr |

TABLE 4-2

| No. | alloy composition (at %) | sintering temperature: 900° C. density g/cm² | 900° C. (BH) max (MGOe) | 1000° C. density g/cm² | 1000° C. (BH) max (MGOe) | 1080° C. density g/cm² | 1080° C. (BH) max (MGOe) | 1160° C. density g/cm² | 1160° C. (BH) max (MGOe) |
|---|---|---|---|---|---|---|---|---|---|
| 1 | Fe—10Co—8B—15Nd—1Al | 5.8 | 12.5 | 6.8 | 20.6 | 7.4 | 31.6 | 7.4 | 30.2 |
| 2 | Fe—20Co—12B—16Nd—1Ti | 5.9 | 6.9 | 6.8 | 13.5 | 7.4 | 22.1 | 7.4 | 18.5 |
| 3 | Fe—2Co—8B—16Nd—2V | 5.7 | 8.0 | 6.8 | 14.0 | 7.4 | 24.0 | 7.3 | 23.5 |
| 4 | Fe—20Co—8B—15Nd—1Cr | 5.9 | 13.0 | 6.9 | 22.5 | 7.4 | 30.5 | 7.4 | 29.5 |
| 5 | Fe—2Co—8B—14Nd—0.5Mn | 5.8 | 7.3 | 6.8 | 15.8 | 7.4 | 25.5 | 7.4 | 25.3 |
| 6 | Fe—5Co—8B—17Nd—1Zr | 5.9 | 11.5 | 6.8 | 23.0 | 7.4 | 30.8 | 7.4 | 28.3 |
| 7 | Fe—20Co—13B—14Nd—0.3Hf | 5.8 | 9.5 | 6.9 | 17.3 | 7.5 | 25.4 | 7.4 | 24.2 |
| 8 | Fe—35Co—7B—15Nd—3Nb | 5.8 | 7.3 | 6.8 | 12.3 | 7.5 | 21.6 | 7.5 | 21.0 |
| 9 | Fe—10Co—8B—15Nd—1Ta | 5.7 | 13.5 | 6.7 | 23.5 | 7.5 | 31.5 | 7.5 | 30.8 |
| 10 | Fe—2Co—8B—15Nd—1W | 5.9 | 13.6 | 6.8 | 25.8 | 7.5 | 33.2 | 7.5 | 32.5 |
| 11 | Fe—20Co—13B—14Nd—1Mo | 5.8 | 12.8 | 6.9 | 15.9 | 7.4 | 25.4 | 7.4 | 24.1 |
| 12 | Fe—20Co—8B—13Nd—0.3Ge | 6.0 | 7.1 | 6.8 | 13.3 | 7.4 | 28.1 | 7.4 | 26.5 |
| 13 | Fe—10Co—9B—14Nd—0.5Sn | 5.9 | 8.1 | 6.8 | 13.8 | 7.4 | 26.1 | 7.4 | 24.0 |
| 14 | Fe—5Co—8B—15Nd—0.2Bi | 5.8 | 11.8 | 6.8 | 24.1 | 7.4 | 31.5 | 7.4 | 30.8 |
| 15 | Fe—5Co—8B—15Nd—1Ni | 5.8 | 8.9 | 6.7 | 15.8 | 7.4 | 25.3 | 7.4 | 25.0 |
| 16 | Fe—10Co—9B—14Pr—1W | 5.9 | 9.8 | 6.8 | 18.0 | 7.4 | 26.5 | 7.4 | 24.8 |
| 17 | Fe—5Co—7B—11Nd—4Dy—0.5Al | 5.8 | 10.3 | 7.0 | 18.5 | 7.6 | 24.8 | 7.6 | 24.3 |

We claim:

1. A process for producing permanent magnet materials of the Fe-B-R type comprising:

preparing a metallic powder having a mean particle size of 0.3–80 microns and a composition consisting essentially of by atomic percent, 12–24% R wherein R is at least one rare earth element selected from the group consisting of Nd, Pr, La, Ce, Tb, Dy, Ho, Er, Eu, Sm, Gd, Pm, Tm, Yb, Lu and Y and at least 50% of R consists of Nd and/or Pr, 4–24 % B, and at least 52% Fe, compacting said metallic powder, and sintering the resultant body at a temperature of 900–1200 degrees C. in a nonoxidizing or reducing atmosphere.

2. A process as defined in claim 1, wherein said metallic powder comprises Co which is substituted for Fe in an amount not exceeding 50 atomic percent wherein the Curie temperature of the sintered body is higher than the Curie temperature of a corresponding sintered body containing no Co.

3. A process as defined in claim 1, wherein said metallic powder comprises at least one of additional elements M in amount(s) not exceeding the values by atomic percent as specified hereinbelow provided that, when two or more elements M are added, the total amount thereof shall not exceed the largest value among said specified values of the elements actually added:

| | | |
|---|---|---|
| 3.3% Ti, | 6.5% Ni, | 5.0% Bi, |
| 6.8% V, | 10.1% Nb, | 8.5% Ta, |
| 5.7% Cr, | 6.2% Mo, | 6.0% W, |
| 6.0% Mn, | 6.5% Al, | 1.4% Sb, |
| 4.5% Ge, | 1.9% Sn, | 3.8% Zr, and |
| 3.8 % Hf. | | |

4. A process as defined in claim 3, wherein said metallic powder comprises Co which is substituted for Fe in an amount not exceeding 50 atomic percent wherein the Curie temperature of the sintered body is higher than the Curie temperature of a corresponding sintered body containing no Co.

5. A process as defined in any one of claims 1–4 wherein the metallic powder is prepared by melting metallic material, cooling the resultant alloy and pulverizing the alloy to form said metallic powder.

6. A process as defined in claim 5, wherein the cooling is made under such a condition that yields a substantially crystalline state.

7. A process as defined in any one of claims 1–4, wherein the metallic powder is prepared by heating a mixture of rare earth oxide and other metallic materials with a reducing agent to reduce the rare earth oxide.

8. A process as defined in any one of claims 1–4, wherein the compacting is carried out in a magnetic field whereby the sintered body has a maximum energy product of at least 10 MGOe.

9. A process as defined in any one of claims 1–4, wherein said metallic powder comprises, by atomic percent, 12–20% R, and 5–18% B, and the compacting is carried out without applying a magnetic field whereby the sintered body has a maximum energy product of at least 4 MGOe.

10. A process as defined in any one of claims 1–4, wherein the sintering is carried out at 1000–1180 degrees C.

11. A process as defined in claim 9, wherein the sintering is carried out at 1000–1180 degrees C.

12. A process as defined in claim 1, wherein the sintering is carried out in an inert gas atmosphere or in a vacuum.

13. A process as defined in claim 12, wherein the vacuum is $10^{-2}$ Torr or less.

14. A process as defined in claim 12, wherein the sintering is conducted in the atmosphere of a normal pressure or a reduced pressure.

15. A process as defined in any one of claims 1–4, wherein the mean particle size of the metallic powder is 1.0–40 microns.

16. A process as defined in claim 15, wherein the mean particle size of the metallic powder is 2–20 microns.

17. A process as defined in any one of claims 1–4, wherein R is 12.5–20%, and B is 4–20%.

18. A process as defined in claim 17, wherein R is 13–19%, and B is 5–11%.

19. A process as defined in claim 2 or 4 wherein Co does not exceed 35%.

20. A process as defined in claim 19 wherein Co does not exceed 25%.

21. A process as defined in claim 2 or 4, wherein Co is 5% or more.

22. A process as defined in claim 9, wherein R is 12–16% and B is 6–18% whereby the sintered body has a maximum energy product of at least 7 MGOe.

23. A process as defined in any one of claims 1–4, wherein said metallic powder is selected so as to maintain the amount of Si in the resultant sintered body at a value not exceeding 5 atomic percent.

24. A process as defined in any one of claims 1–4, wherein the metallic powder is an alloy powder having said composition.

25. A process as defined in any one of claims 1–4, wherein the metallic powder is a mixture of alloy powders making up said composition.

26. A process as defined in any one of claims 1–4, wherein the metallic powder is a mixture of an alloy or alloys having an Fe-B-R base composition and a powder metal having a complementary composition making up the final composition of said metallic powder.

27. A process as defined in claim 26, wherein said powdery metal comprises an alloy or alloys of the componental elements of said final composition.

28. A process as defined in claim 26, wherein said powdery metal comprises a componental element(s) of said final composition.

29. A process as defined in claim 17, wherein the impurites do not exceed the values, by atomic percent, specified below:

| | | |
|---|---|---|
| 2.0% Cu, | 2.0% C, | 2.0% P, |
| 4.0% Ca, | 4.0% Mg, | 2.0% O, |
| 5.0% Si, and | 2.0% S. | |

provided that the sum of the impurities does not exceed 5%.

30. A process as defined in claim 9, wherein the amount of Fe is at least 62 atomic percent.

31. A process as defined in any one of claims 1–4, wherein R is Nd and/or Pr.

32. A process as defined in claim 31, wherein R is Nd.

* * * * *